US007066807B2

(12) United States Patent
Abe et al.

(10) Patent No.: US 7,066,807 B2
(45) Date of Patent: Jun. 27, 2006

(54) COMPACT RECEIVING AND DISPENSING DEVICE

(75) Inventors: Hiroshi Abe, Iwatsuki (JP); Masayoshi Umeda, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 384 days.

(21) Appl. No.: 10/384,487

(22) Filed: Mar. 7, 2003

(65) Prior Publication Data

US 2003/0201146 A1 Oct. 30, 2003

(30) Foreign Application Priority Data

Mar. 12, 2002 (JP) ..... 2002-067120
Feb. 13, 2003 (JP) ..... 2003-034618

(51) Int. Cl.
*G07D 3/00* (2006.01)

(52) U.S. Cl. ..... 453/7; 453/11; 453/14; 453/56; 194/338

(58) Field of Classification Search ..... 453/7, 453/10, 11, 14, 15, 49, 56, 57; 206/83, 84; 232/56; 194/334, 338
See application file for complete search history.

(56) References Cited

U.S. PATENT DOCUMENTS 3,079,934 A * 3/1963 Thompson ..... 453/9
4,167,949 A * 9/1979 Hashimoto et al. ..... 453/12
4,635,661 A * 1/1987 Uematsu et al. ..... 194/217
5,163,868 A * 11/1992 Adams et al. ..... 453/11
5,724,785 A * 3/1998 Malanowski ..... 53/48.1
5,908,351 A * 6/1999 Tanaka ..... 453/11
5,989,118 A 11/1999 Chiba et al.
6,109,416 A * 8/2000 Nickerson ..... 194/206

FOREIGN PATENT DOCUMENTS

JP 404294480 A * 10/1992 ..... 453/3
JP 405159128 A * 6/1993 ..... 453/17
JP 6-274740 9/1994
JP 9-319912 12/1997

* cited by examiner

*Primary Examiner*—Gene O. Crawford
*Assistant Examiner*—Jeffrey A Shapiro

(57) ABSTRACT

A receiving and dispensing device for coins comprises a coin receiving device to receive the entry of coins of various denominations. The coins are segregated and verified as to authenticity. The coins are then transported along an upper and lower selecting section which are connected by appropriate guiding passageways to sets of upper and lower coin hoppers aligned in both a horizontal and vertical configuration to form a compact configuration.

12 Claims, 17 Drawing Sheets

COMPACT RECEIVING AND DISPENSING DEVICE

BACKGROUND OF THE INVENTION

1. Field of the Invention

The present invention is directed to a coin receiving and dispensing machine that can segregate and store a number of types of different coins and more particularly to a device that can store the respective segregated coins in a compact arrangement of coin hoppers that are capable of selectively dispensing the coins as needed.

2. Description of Related Art

The ability to segregate and store coins such as monetary coins, tokens, medallions, metals, etc., and particularly coins of a cycloid type is known such as disclosed in the Japanese laid-open Patent Applications No. 6-274,740 and No. 9-319,912. The first coin receiving and dispensing device provides, for example, a plurality of coin hoppers that can store coins in bulk with the hoppers being arranged in two sets of horizontal rows. While the height of such a device is lowered, the width must be increased to accommodate a large number of coin hoppers. The second prior art device also discloses a plurality of coin hoppers where the hoppers are positioned vertically in a parallel arrangement. While this permits the width of the device to be relatively narrower, its height is larger.

U.S. Pat. No. 5,989,118 discloses a coin receiving and dispensing machine that can move coins about the perimeter of the housing to both sort and authenticate the coins and deposits the coins in temporary storage sections.

There is still a need in the prior art to provide an improved compact and efficient coin segregating and dispensing devices

SUMMARY OF THE INVENTION

The present invention provides a receiving and dispensing device where coins can be introduced within a housing to enable the coins to initially be authenticated and separated for subsequent transporting to segregate the coins in accordance with a criterion such as the monetary value of the coins. A transporting passageway permits coins of various widths to be moved along an upper and lower selecting section and released from the transporting passageway. An endless belt is capable of moving the coins along guiding rails and gauge rails having openings of a particular width to accommodate specific coin denominations. Two sets, each of a plurality of hoppers, are provided with one set aligned on a lower horizontal section and operatively positioned to be connected through guiding passageways with a lower selecting section. The coins that pass the first selecting section can be elevated to pass through an upper second selecting section which can communicate through guiding passageways with another set of upper coin hoppers. The arrangement of the two sets of coin hoppers in a stacked vertical configuration facilitates both a compact and relatively inexpensive design.

Thus, the positioning of the coin hoppers in a horizontal and vertical alignment while accommodating also a stacked alignment of selecting sections corresponding to the coin hoppers enables an improved compact design of the present invention. The guiding passageway connections between the respective sets of coin hoppers provides a relatively direct and short movement of the coins into the coin hoppers, thereby lowering any opportunity for jamming. The transporting passageways can cause the coins to slant so that the coins will interface with the selecting sections and thereby fall by gravity through the guiding passageways to the appropriate coin hopper. The use of guiding rail and gauge rails in parallel configurations for the selecting sections facilitates the determination of releasing specific diameter coins to the appropriate coin hoppers.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
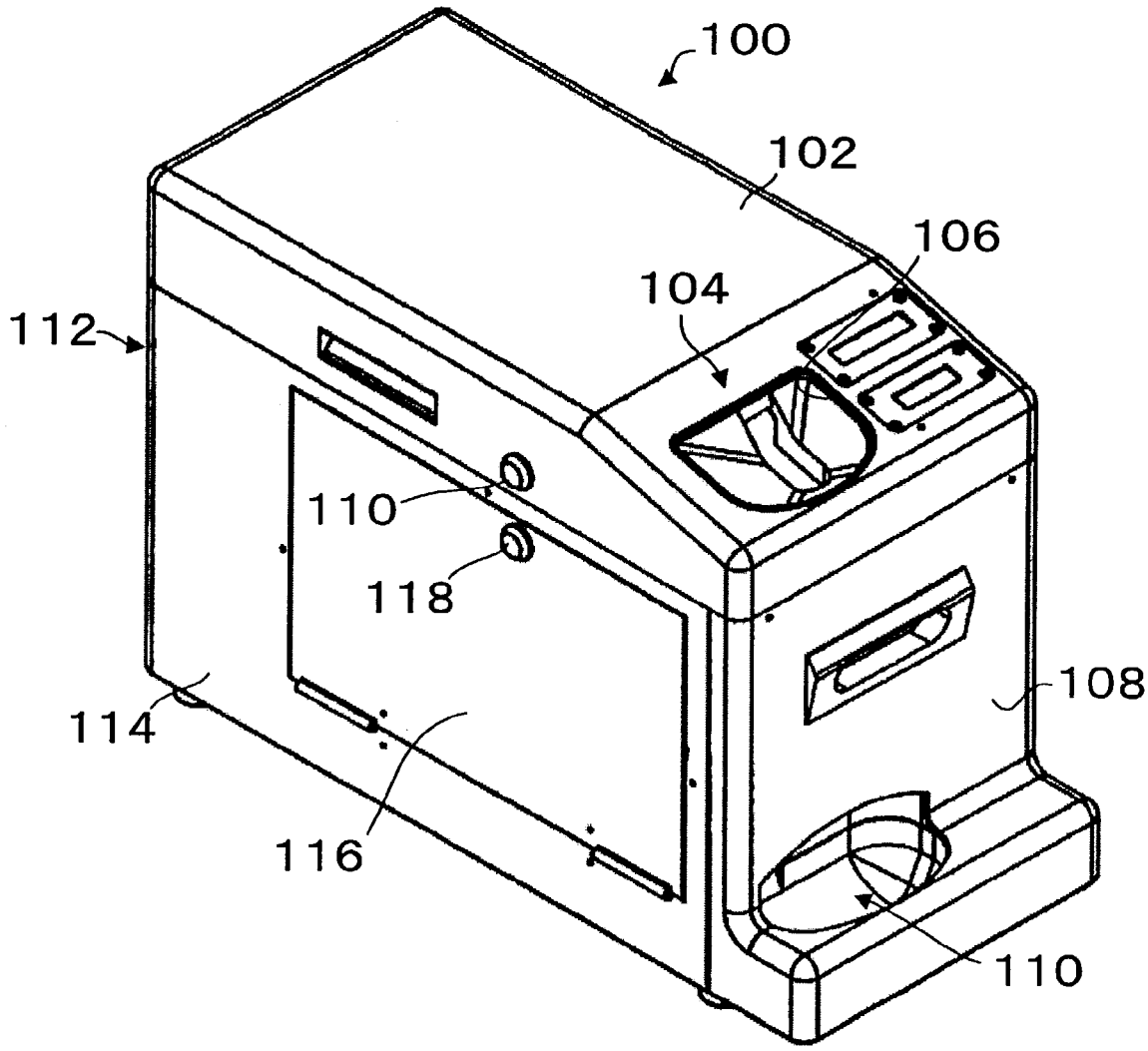
FIG. 1 is a perspective view of a coin receiving and dispensing device of first embodiment of the present invention which is shown from the front and above.
Figure 2:
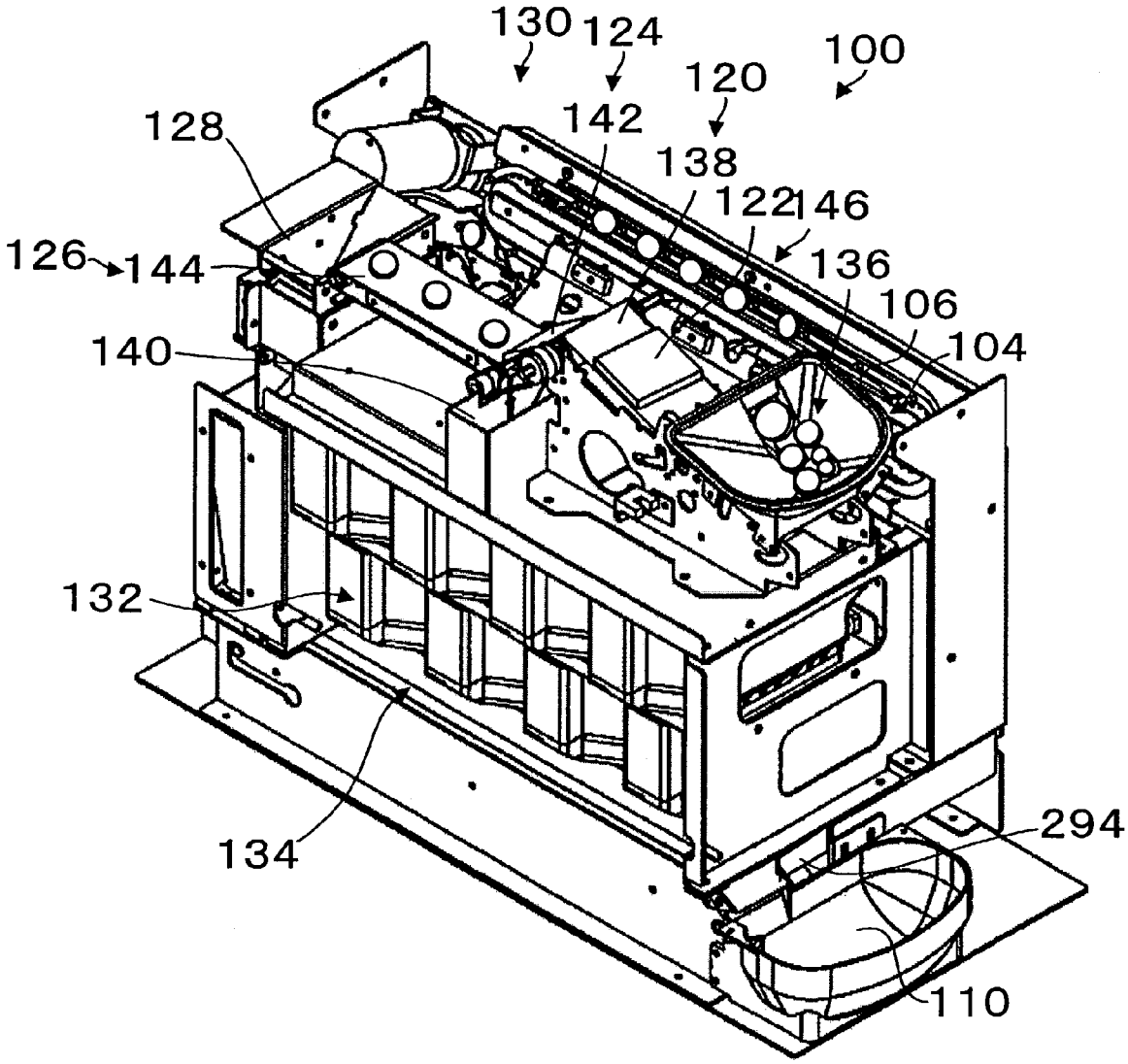
FIG. 2 is a perspective view of the first embodiment with the cover removed.

The term Coins is used generically and can be monetary coins, medals, tokens or other cylindrical discs of value. A first embodiment is explained by referring to FIG. 1 to FIG. 8. Coin receiving and dispensing device 100 is a rectangular in shape and has an upper cover 102 with a receiving slot 106 in receiving device 104 and a dispensing slot 110 below a front cover 108. Upper cover 102 can pivot upwards at a supporting point which is located at one side of upper cover 102 (at the right in the FIG. 1) to enable maintaining and/or servicing of transporting devices 120, 126 and/or selector 122.

Upper cover 102 is locked to body 112 by an upper cover locking device 110. A part of the left side cover 114 can be opened by movement of rectangle side cover 116. Side cover 116 is further locked to body 112 by side cover locking device 118. When side cover 116 is opened, a plural number of coin hoppers can be easily maintained or be supplied or have the coins removed from a coin hopper.

Coin receiving and dispensing device 100 includes a receiving device 104, a first transporting device 120 and a coin selector 122, a diverting device 124, a second transporting device 126, a temporally storing section 128, a selecting transporting device 130, a coin storing section 132, a coin dispensing device 134 and a dispensing slot 110 which are respectively aligned in a compact configuration. Coin receiving device 104 has a turned up funnel shape and has a receiving slot 106 which is also a turned up rectangle opening 106.

The lower end of receiving device 104 has a sideways opening which is located over the first transporting device 120. First transporting device 120 has a function that coins 136, which are entered into receiving device 104, are transported to a diverting device 124 through a coin selector 122. First transporting device 120 is a plane endless belt 138 which is made from rubber. Coins 136 fall down on belt 138, afterwards they are leveled by a coin leveling device (not shown) and are spaced a predetermined distance.

Belt 138 slants upwards from receiving device 104 to diverting device 124. The belt 138 moves the coins so that a gravity chute with corresponding space is not used. Coin selector 122 is located over the middle of belt 138. Coin selector 122 has a function to distinguish genuine or false denominations of coins.

The structure of coin selector 122 is to secure data concerning diameter, thickness and material, and it uses a plurality of sensor units such as coils. The data is then compared to standard values of authenticate coins to distinguish between genuine or false denominations.

When a coin is false, it will fall into a returning passageway 140 at diverting device 124. Afterwards it is transported to a dispensing slot 110 by dispensing device 134. When a coin is genuine, the coin is transported by a second transporting device 126 to a temporary storing device 128.

Diverting device 124 is a sliding board 142 which is slanted downward from first transporting device 120 to the second transporting device 126. Sliding board 142 can pivot at the lower end of slanting board 142 over the second transporting device 126 by a solenoid (not shown). When sliding board 142 pivots, a falling opening is made up between the upper end of sliding board 142 and the end of first transporting device 120. The returning passageway 140 is located below the falling opening and extends vertically, and the lower opening is located over transporting device 134.

Second transporting device 126 is also a plane endless belt 144 and it is positioned horizontal. Temporary storing device 128 has a function that it receives coins 136 which are transported by the second transporting device 126 to be stored temporary, before they are dispensed either by a selecting transporting device 130 or a dispensing device 134. Temporary storing device of this embodiment can be a box which has gates which are selectively opened at the bottom to either selecting transporting device 130 or dispensing device 134.

Figure 4:
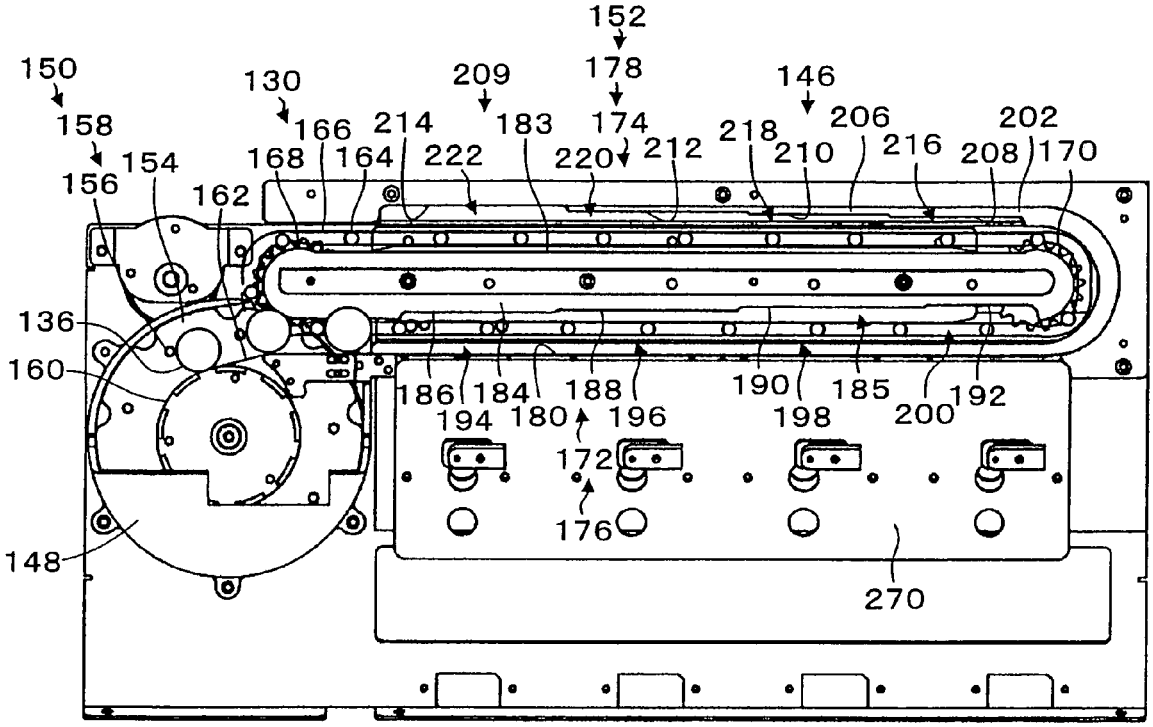
FIG. 4 is a front view of the coin transporting device of the first embodiment.

Next, selecting transporting device 130 is explained by referring to FIG. 4. Selecting transporting device 130 has a function which separates the received coins from the temporary storing device 128 in a one by one manner and transports the coins to the coin selecting section 146. The selecting transporting device 130 includes separating section 150 and transporting section 152.

Separating section 150 separates the coins which are provided in hopper bowl 148 one by one. Transporting section 152 transports the separated coins 136 to coin selecting section 146.

Separating section 150 includes a rotating disc 158, supporting tier 160 and knife 162. The rotating disc 158 includes a circular disc 154 which is slanted, and pins 156 which are fixed on the circular disc 154 at a predetermined distance to support coins. The supporting tier 160 includes a smaller second circular structure than the circular disc 154 that is concentric but in a plane parallel and at a distance away from the surface of disc 154 to support coins 136. The knife 162 receives coins 136 which are transported by the supporting tier 160 and the pins 156.

Coins 136 are received by knife 162, and transported to the coin selecting section 146 at transporting section 152. The transporting section 152 includes an endless belt 166 which has pins 164 which are fixed on the endless belt 166 at a predetermined distance. Endless belt 166 can be a plane belt, a timing belt or a chain, etc. The endless belt 166 is connected to a pair of wheels 168 and 170 which are slanted horizontally and the belt 166 is flat and looped.

Figure 5:
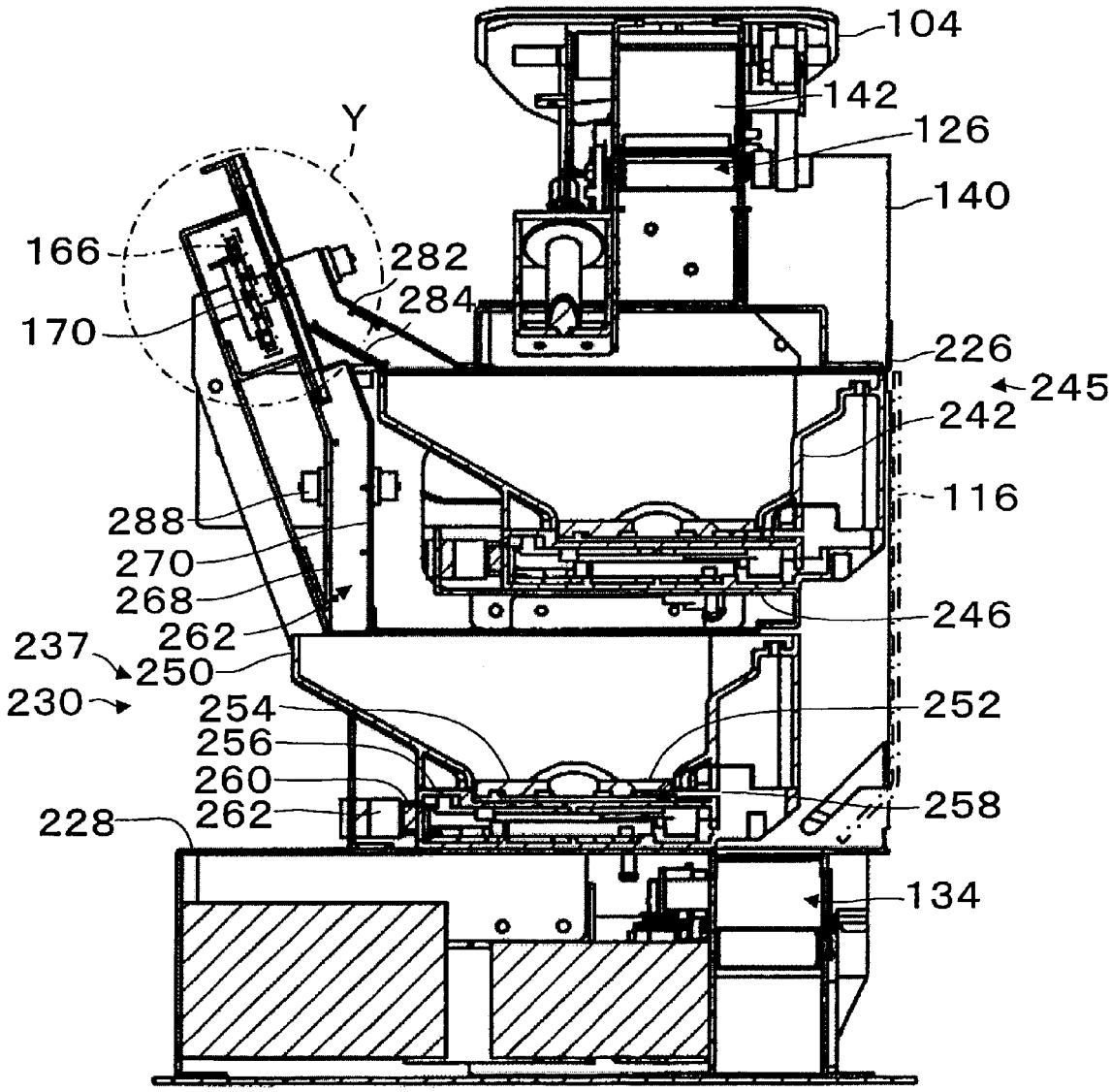
FIG. 5 is a cross section view taken along the X—X line of FIG. 3.

The endless belt 166 has a lower straight section 172 and an upper straight section 174, which are parallel and horizontal. Lower straight section 172 and upper straight section 174 are out of alignment relative to upper and lower, and left and right arrangement (as shown in FIG. 5). The coin selecting section 146 is located along the lower straight section 172 and upper straight section 174. The coin selecting section 146 includes a lower selecting section 176 which corresponds to the lower straight section 172 and an upper selecting section 178 which corresponds to the upper straight section 174.

Lower selecting section 176 includes lower guiding rail 180, lower reclining board 182 and lower gauge rail 184. Coins 136 roll on the lower guiding rail 180 and the position of the lower edges is controlled by the guiding rail 180. Lower reclining board 182 has close contact with lower guiding rail 180 on the under side and is located over the lower guiding rail 180. Lower gauge rail 184 is positioned away from lower guiding rail 180 at a predetermined distance and is parallel.

Figure 6:
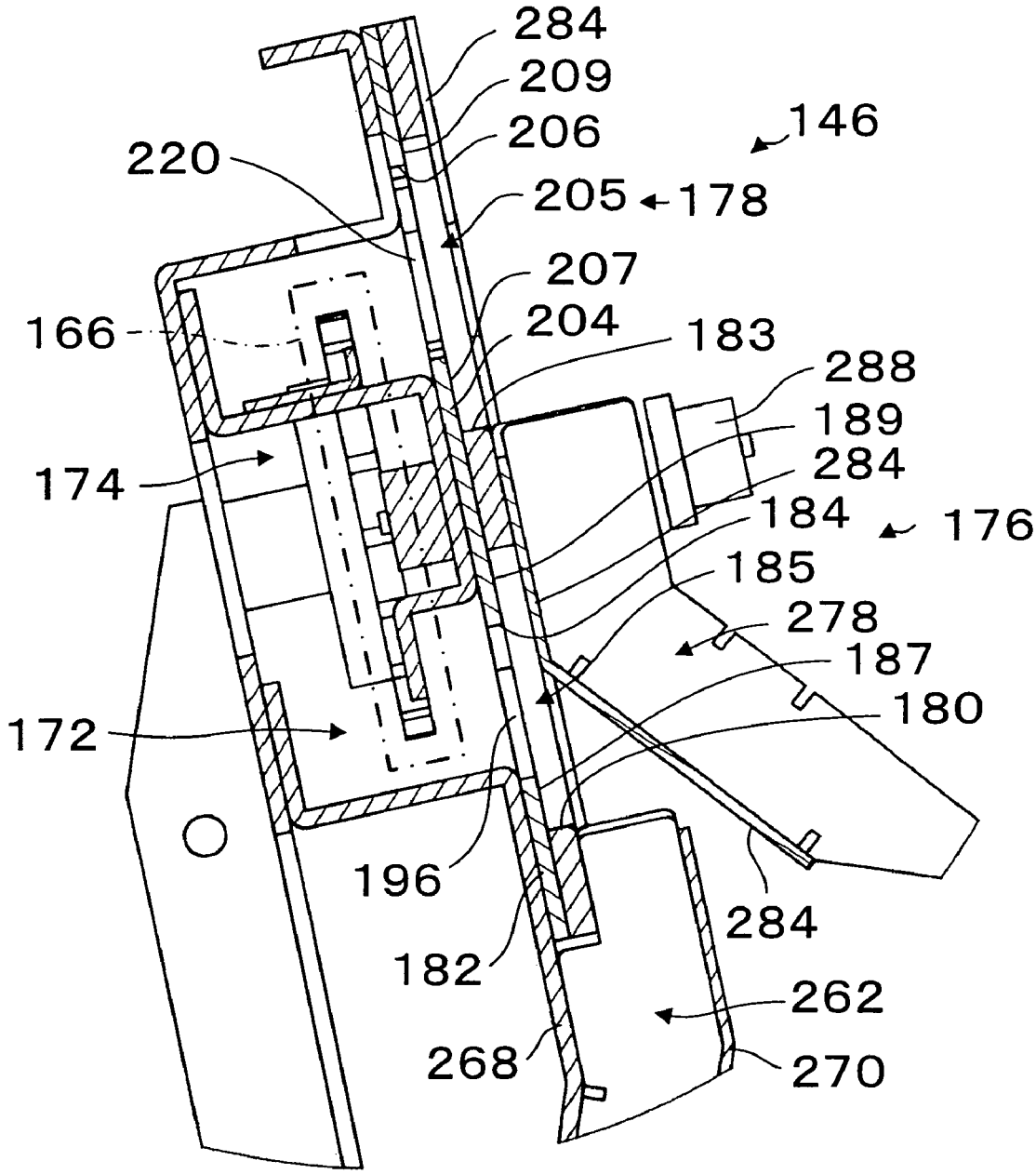
FIG. 6 is an enlarged partial cross sectional view of the Y section of FIG. 5.

Lower guiding rail 180 and upper guiding rail 182 are located in a plane which slants the same as endless belt 166 as shown in FIG. 6. Lower gauge rail 184 and upper gauge rail 206 are located in a plane which slants the same as endless belt 166.

Lower transporting passageway 185 is a space where it is enclosed by lower guiding rail 180, an upper side surface 187 of lower reclining board 182 and an upper side surface 189 of lower gauge rail 184. Guiding board 284 is located beside the upper portion of lower transporting passageway 185, the upper side of coins 136 are guided by the guiding board 284. Coins 136 roll on lower transporting passageway 185. In this process, the lower surfaces of coins 136 have contact with lower guiding rail 180 at lower transporting passageway 185 by gravity and the lower side surfaces are supported by upper side surface 187 of lower reclining board 182 and the upper side surfaces are supported by upper side surface 189. Gauge sections are arranged in order of diameter from the knife 162 side at lower gauge rail 184.

When the coins are Euro coins, the dimensions are as follows: 1 cent gauge 186, 2 cent gauge 188, 10 cent gauge 190 and 5 cent gauge 192 which are arranged in the lateral direction as shown in FIG. 4. The distance between lower guiding rail 180 and 1 cent gauge 186 is made to be slightly larger than the diameter of 1 cent coin. Accordingly, selected 1 cent coins which roll on lower guiding rail 180 are guided by upper side surface 189 of lower gauge rail 184 and upper side surface 187 of lower reclining board 182 and as a result the coins don't fall down.

A 1 cent coin falls down into a 1 cent falling hole 194 when it isn't supported by the lower gauge rail 184. The other gauge sections are made in the same manner. Therefore a 2 cent coin falls down into a 2 cent falling hole 196 at a 2 cent gauge section 188. A 10 cent coin falls down into a 10 cent falling hole 198 at a 10 cent gauge section 190. A 5 cent coin falls down into a 5 cent falling hole 200 at a 5 cent gauge section 192.

Upper selecting section 178 includes upper guiding rail 182, upper reclining board 204 and upper gauge rail 206. Coins 136 roll on upper guiding rail 182 and the position of the lower edges are controlled by the guiding rail 182. Upper gauge rail 206 is positioned away from upper guiding rail 182 at a predetermined distance and is parallel.

Upper reclining board 204 is located parallel to upper guiding rail 182. Upper reclining board 204 has close contact with upper guiding rail 202 on the under side and is located over upper guiding rail 182. Accordingly, upper reclining board 204 and lower reclining board 182 are located in the same plane which is slanted.

Lower reclining board 182 and upper reclining board 204 can be unified if desired.

Upper transporting passageway 205 is a space which is enclosed by upper guiding rail 182, the upper side surface 207 of upper reclining board 204 and upper side surface 209 of upper gauge rail 206. Guiding board 284 is located beside the upper side of upper transporting passageway 205 the same as lower transporting passageway 185. Coins 136 roll on upper transporting passageway 205. In this process, the lower surfaces of coins 136 have contact with upper guiding rail 182 at an upper transporting passageway 205 by gravity and the lower side surfaces are supported by upper side surface 207 of upper supporting board 204 and the upper side surfaces are supported by upper side surface 209.

Gauge sections are arranged in order of diameter from the lower selecting section 176 side at upper gauge rail 206. When they are Euro coins, such 20 cent gauge 208, 1 Euro gauge 210, 50 cent gauge 212 and 2 Euro gauge 224 are arranged to lateral direction. The distance between upper guiding rail 182, and each gauge sections is made up in the same manner as the case of a 1 cent coin.

Accordingly, a 20 cent coin which rolls on upper guiding rail 202 isn't guided by upper side surface 209 of upper gauge rail 206, and as a result it falls down into 20 cent falling hole 216. A 1 Euro coin falls down into a 1 Euro falling hole 218 at a 1 Euro gauge section 210. A 50 cent coin falls down into a 50 cent falling hole 220 at a 50 cent gauge section 212. A 2 Euro coin falls down into a 2 Euro falling hole 222 at a 2 Euro gauge section 214. Therefore the coin selecting sections are arranged in order of the diameter size from the smallest to largest at the coin selecting section 146. The selecting sections are located corresponding to the outward and inward of selecting transporting device 130. Accordingly, the depth of the coin receiving and dispensing device is smaller and compact.

Lower transporting passageway 185 and upper transporting passageway 205 of selecting transporting device 130 slant towards the face of coins 136. Lower selecting section 176 and upper selecting section 178 are arranged vertically. Therefore the necessary location space of the guiding passageway is decreased in size, and as a result, the width of the coin receiving and dispensing device 100 is smaller.

The slant between the lower transporting passageway 185 and upper transporting passageway 205 is arranged to be suitable, and the range can be from 20 degrees to 40 degrees slanted vertically. When the slanting angle is larger, the width is larger, and as a result, the device becomes larger. When the slanting angle is smaller, the coins fall down too easily from the lower guiding rail 180 and the upper guiding rail 182.

Lower gauge rail 180 and upper gauge rail 182 can be separated; however, they are shown integrated in this embodiment. When they are integrated, it is less expensive, because the number of parts are decreased.

Figure 3:
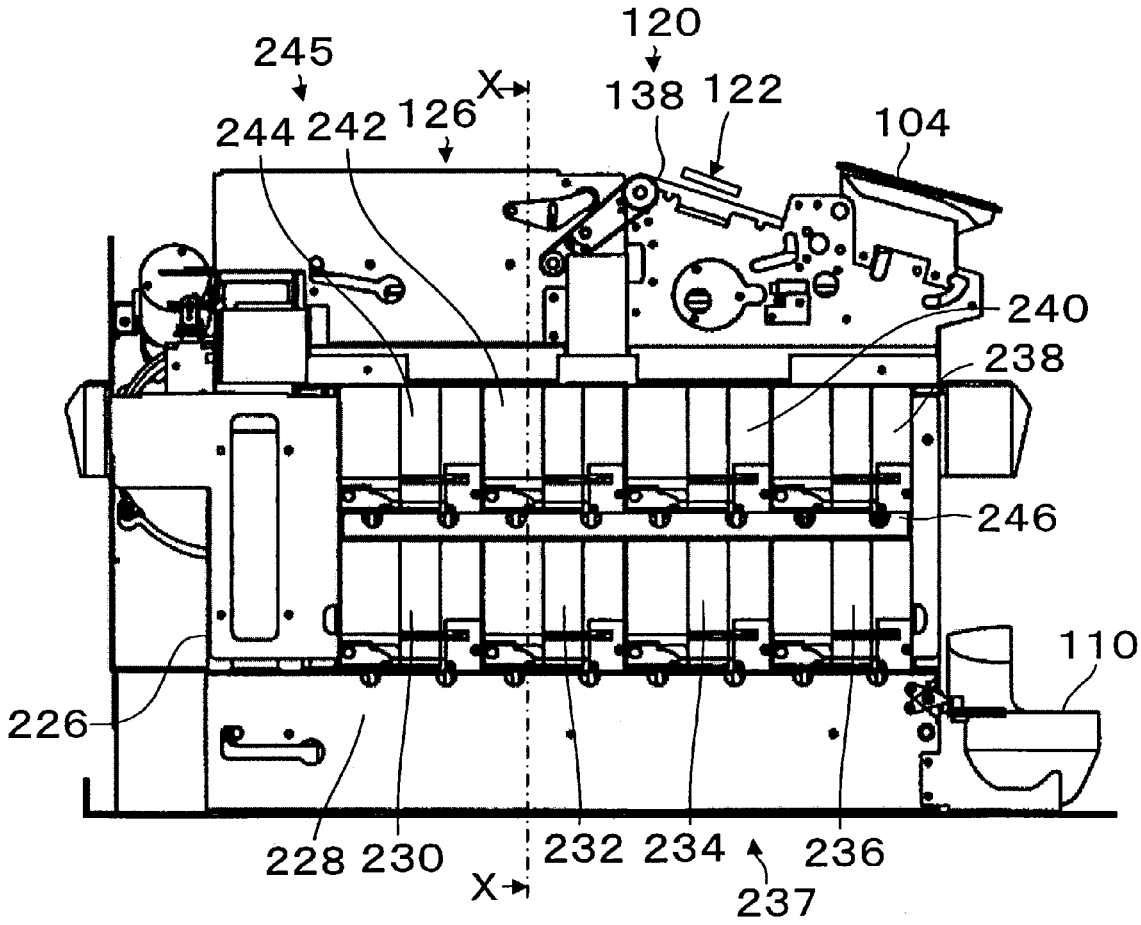
FIG. 3 is a front view of FIG. 2.

Next, coin storing device 132 is explained by referring to FIG. 3. Coin storing device 132 is located under the first transporting device 120 and second transporting device 126. Coin hoppers corresponding to the coin falling holes are located in the coin storing device 132. First coin hopper 230, second coin hopper 232, third coin hopper 243 and fourth coin hopper are located on the base 228 of frame 226 and are arranged parallel to the lower straight section 172 and are aligned in a row. These coin hoppers are the lower coin hopper line 237.

Middle base 246 is located over the base 228. Fifth coin hopper 238, sixth coin hopper 240, seventh coin hopper 242 and eighth coin hopper 244 are located on middle base 246 and are arranged parallel to upper straight section 174 and are lined up in a row. These coin hoppers are the upper coin hopper line 245. Accordingly, the lower coin hopper line 237 and the upper coin hopper line 245 are located above and below, and are located adjacent to each other, and are each parallel in alignment.

Eighth coin hopper 244 is located over first coin hopper 230, seventh coin hopper 242 is located over second coin hopper 232, sixth coin hopper 240 is located over third coin hopper 234 and fifth coin hopper 238 is located over fourth coin hopper 236. In other words, the coin hoppers which are located above and below are also arranged vertically.

As a result of this design arrangement of the hoppers, the depth of the coin receiving and dispensing device 100 is smaller. Also, lower coin hopper line 237 and upper coin hopper line 245 are not completely lined up with the left and the right as shown in FIG. 5, because the after-mentioned guiding passageways are located there. Therefore the width of coin receiving and dispensing device 100 is also smaller, because the lower coin hopper line 237 and the upper coin hopper line 245 are substantively lined up.

Next, the structure of the coin hopper is explained. Second coin hopper 230 is explained because each of the first coin hopper 230 through to the eighth coin hopper 244 have the same structure. Second coin hopper 230 includes coin bowl 250, rotating disk 254 with through hole 252, a electrical motor (not shown) and a counter which counts the coins which are let off by rotating disk 254 as shown in FIG. 5.

Coin bowl 250 is fixed at hopper base 256. The upper section of coin bowl 250 is rectangle and the lower section is cylindrical. Rotating disk 254 is located in the lower cylindrical section of coin bowl 250. Coin exit 258 is located at the side of rotating disk 254.

Coin hopper 230 can be moved to side cover 116 side along guiding rail (not shown) which is located on base 228. In other words, coin hopper 232 can be drawn to the right in FIG. 5. Therefore the replacement of the coins and/or the maintenance of the coin hoppers become convenient.

When coin hopper 230 is moved in the body, connector 260 of the hopper is automatically inserted into connector 262 of the body; as a result, the electric connection and the signal connection are automatically connected. 1 cent coins are stored in first coin hopper 230, 2 cent coins are stored in second coin hopper 232, 10 cent coins are stored in third coin hopper 234, 5 cent coins are stored in fourth coin hopper 236, 20 cent coins are stored in fifth coin hopper, 1 Euro coins are stored in sixth coin hopper, 50 cent coins are stored in seventh coin hopper 242 and 2 Euro coins are stored in eighth coin hopper 244. The coin hopper can be alternatively changed to other coin dispensing devices which have the same function.

Next, the guiding passageways which are connected between coin selecting section 146 and coin storing device 132 are explained by referring to FIGS. 5, 7 and 8. 1 cent guiding passageway 260 is located below falling hole 194, 2 cent guiding passageway 262 is located below falling hole 196, 10 cent guiding passageway 264 is located below falling hole 198 and 5 cent guiding passageway 266 is located below falling hole 200.

These guiding passageways are structured by a plane cover 268, a separating board 270 and a side wall 272, and form tunnels which extend vertically. The lower ends of the guiding passageways are located over the corresponding coin bowls. The upper section of side walls 272 are bent toward and correspond to the gauge section and the widening of the passageway.

Figure 7:
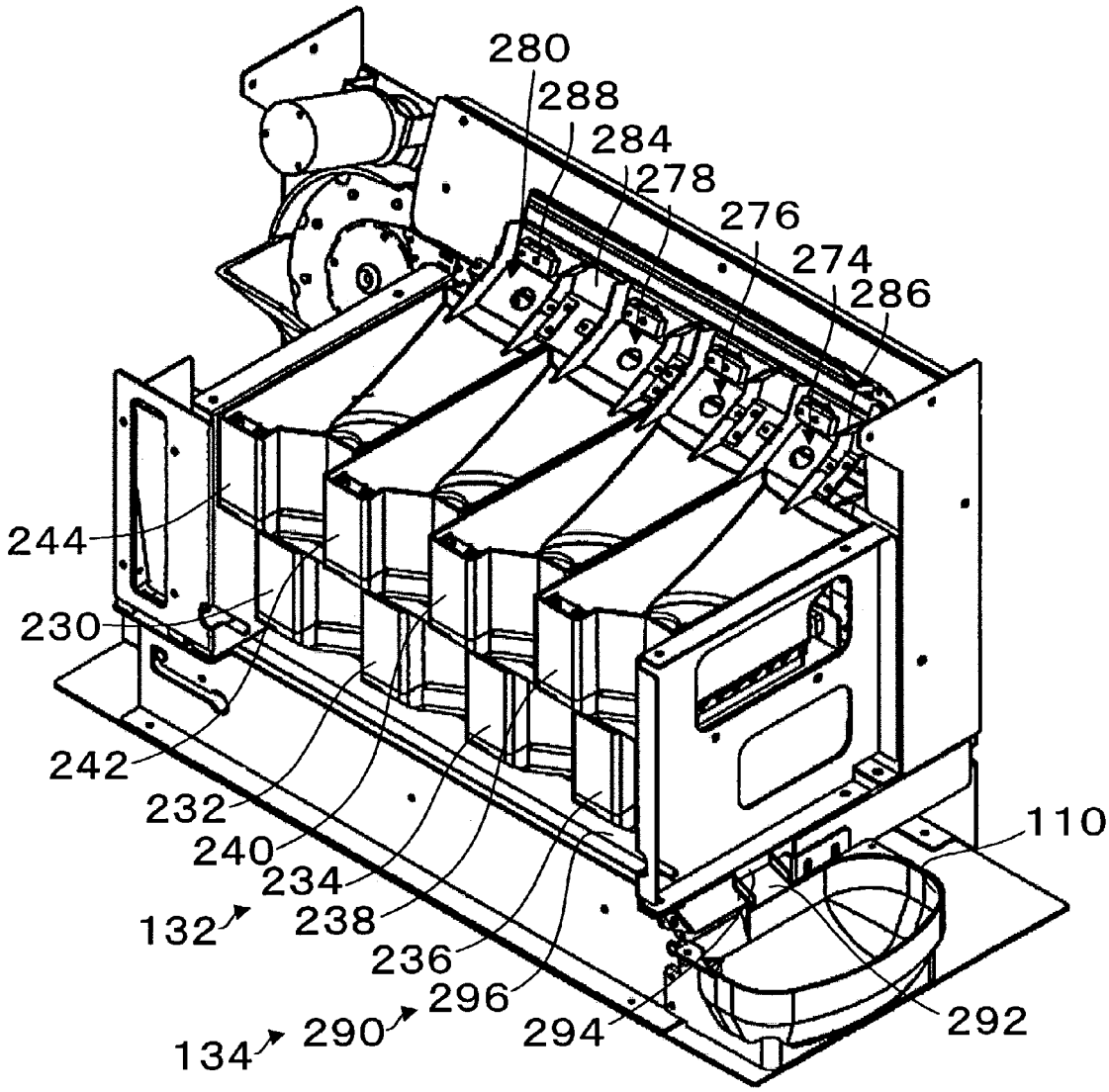
FIG. 7 is a perspective view with the coin receiving device and upper guiding cover removed.
Figure 8:
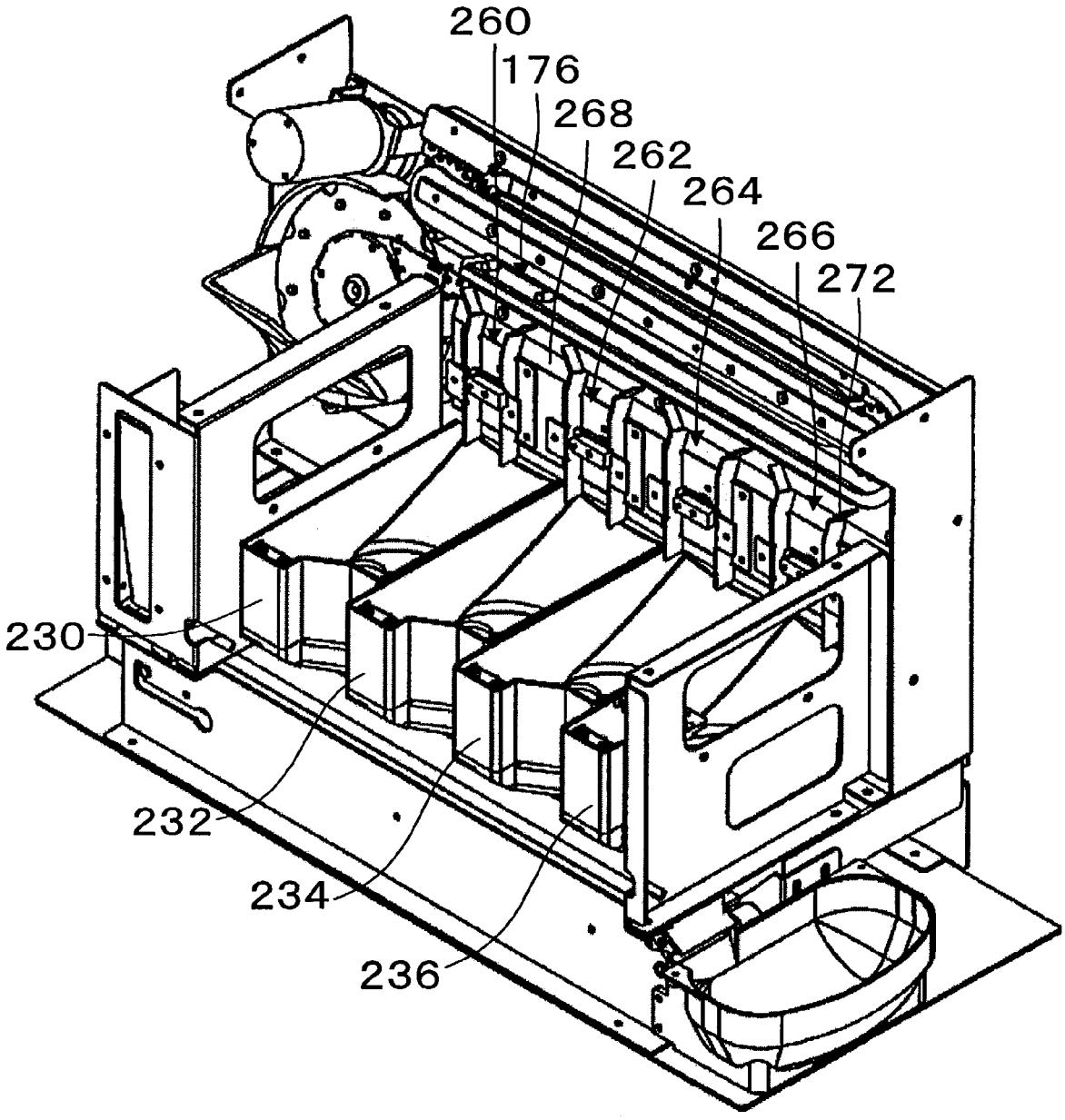
FIG. 8 is a perspective view which has deleted the upper coin hoppers and guiding board from FIG. 7.

A 20 cent guiding passageway 274 is located below falling hole 216, a 1 Euro guiding passageway 276 is located below falling hole 218, a 50 cent guiding passageway 278 is located below falling hole 220 and a 2 Euro guiding passageway 280 is located below falling hole 220 as shown in FIG. 7. These guiding passageways are also structured by upper cover 282, back board 284 and side wall 286, and to form slanted tunnels.

The lower ends of guiding passageways are located over the corresponding coin bowls. Coins which fall down from the falling holes are guided into a corresponding coin bowl by the guiding passageways. Sensor 288 is located on the way to the coin bowl at the guiding passageway, and detects the falling coins.

Next, coin dispensing device 134 is explained. Coin dispensing device 134 includes transporting device 290, chute 292, shutter 294 which is located at the entrance of chute 292. Transporting device 290 is located below the exit 258 of coin hoppers. Transporting device 290 includes plane belt 296, and it is moved towards the normal direction or the opposite direction as shown in FIG. 7.

Belt 296 is located below the upper surface of base 228. When the belt moves in a normal direction, coins 136 are transported towards the dispensing slot's 110 side and fall into chute 292. Afterwards they are dispensed into dispensing slot 110. Cover 116 is a plate and is located opposite to belt 296 on the dispensing slot 258 side.

The dispensed coins from dispensing slot 258 are guided by cover 298 and the wall of the coin hoppers, and they fall down onto belt 296. A safe box (not shown) can be located under belt 296 opposite chute 292. When the coin hoppers dispense the coin, shutter 294 closes the entrance of chute 292, because the coins are prevented from coming out of dispensing slot 110.

When the coin is dispensed, shutter 294 is opened and belt 296 moves towards the dispensing slot 110 side, and they are dispensed into dispensing slot 110 through chute 292. The transporting device 290 can be alternatively changed to other types which have same the function to dispense the dispensed coins to dispensing slot 110. When a coin hopper has reached its capacity, the new received coins are diverted into returning passageway 140 by diverting device 124, and they are transported into a safe box (not shown) by belt 296.

Next, the operation of present embodiment is explained. Firstly, in the case where the received coins 136 are stored in corresponding coin hoppers is explained. Coins 136 which are received into receiving slot 106 are transported by first transporting device 120 and are arranged to line up at a predetermined spaced distance. Afterwards the coins are distinguished by coin selector 122 and when they are genuine, the denomination is distinguished.

When the coins are false, they are guided into returning passageway 140 by diverting device 124 and fall down on dispensing device 134 and are returned to dispensing slot 110. When the coins are genuine, the coins slide on sliding board 142 and go on second transporting device 126 and are transported into temporary storing device 128 by second transporting device 126. Coins 136 fall into temporary storing device 128 and are stored. When customers choose to return their money, storing coins 136 fall down onto dispensing device 134 and are returned to dispensing slot 110 by dispensing device 134.

When no signal is given for the return of the coins, storing coins 136 are provided into hopper bowl 148. Coins 136 in hopper bowl 148 are hooked by pins 156 and are supported by tier 160 and are separated one by one and go to knife 162.

Coin 136 which is received by knife 162 is moved to transporting section 152 by pin 156. In this process, the coin 136 is pushed by pin 164 of endless belt 166 which synchronizes its movement to rotating disc 158. Therefore coin 136 moves from knife 162 to lower guiding rail 180.

Coin 136 is guided by lower guiding rail 180, lower reclining board 182 and lower gauge rail 184, and it moves towards dispensing slot 110 in lower transporting passageway 185. When the coin is a 1 cent coin, the coin isn't supported by the upper side surface at gauge section 186; as a result, it falls down into falling hole 194, and it is guided to coin bowl 250 of first coin hopper 230 by 1 cent guiding passageway 260. When the coin is a 2 cent coin, it isn't supported at gauge section 188; as a result, it falls down into 2 cent falling hole 196, and it is guided to coin bowl 250 of second coin hopper 232 by 2 cent guiding passageway 262.

When the coin is a 10 cent coin, it isn't supported at gauge section 190; as a result, it falls down into 10 cent falling hole 198, and it is guided to coin bowl 250 of third coin hopper 234 by 10 cent guiding passageway 264. When the coin is a 5 cent coin, it isn't supported at gauge section 192; as a result, it falls down into 5 cent falling hole 200, and it is guided to coin bowl 250 of fourth coin hopper 236 by 5 cent guiding passageway 266.

A 20 cent, a 1 Euro, a 50 cent and a 2 Euro coins don't fall down at lower selecting section 176. Accordingly, the coins are turned at wheel 170 section and go to upper selecting section 178. The coins are guided by upper guiding rail 202, upper reclining board 204 an upper gauge rail 206 and are transported to selecting section 150 side in upper transporting passageway 205.

When the coin is a 20 cent coin, it isn't supported at gauge section 208. As a result, it falls down into 20 cent falling hole 216, and it is guided to coin bowl 250 of fifth coin hopper 238 by 20 cent guiding passageway 274. When the coin is a 1 Euro coin, it isn't supported at gauge section 210; as a result, it falls down into the 1 Euro falling hole 218, and it is guided to coin bowl 250 of sixth coin hopper 240 by 1 Euro guiding passageway 276.

When the coin is a 50 cent coin, it isn't supported at gauge section 212; as a result, it falls down into 50 cent falling hole 220, and it is guided to coin bowl 250 of seventh coin hopper 242 by the 50 cent guiding passageway 278. When the coin is a 2 Euro coin, it isn't supported at gauge section 214; as a result, it falls down into the 2 Euro falling hole 222, and it is guided to coin bowl 250 of sixth coin hopper 244 by the 2 Euro guiding passageway 280.

Next, the case where the denomination coins are dispensed one by one is explained. First coin hopper 230, eighth coin hopper 244, second coin hopper 232, seventh coin hopper 242, third coin hopper 234, sixth coin hopper 240, fourth coin hopper 236 and fifth coin hopper 238 are positioned in order to start; however, they do not all engage at the same time to prevent coins from jamming. Rotating discs 254 rotate at each coin hopper, and one coin is dispensed from dispensing slot 258.

The dispensed coins are guided by each coin hopper and cover 116, and they fall down on belt 296. When the coin dispensing is finished, belt 296 moves towards chute's 292 side. Accordingly, coins 136 fall down on chute 292, and they slide down into dispensing slot 110.

All coins fall down to chute 292, finally belt 296 stops. When the coins in each coin hopper are recycled, belt 296 is moved in the reverse direction, and the coins are dispensed by each coin hopper. The dispensed coins can fall down from belt 296 and be recycled.

Figure 9:
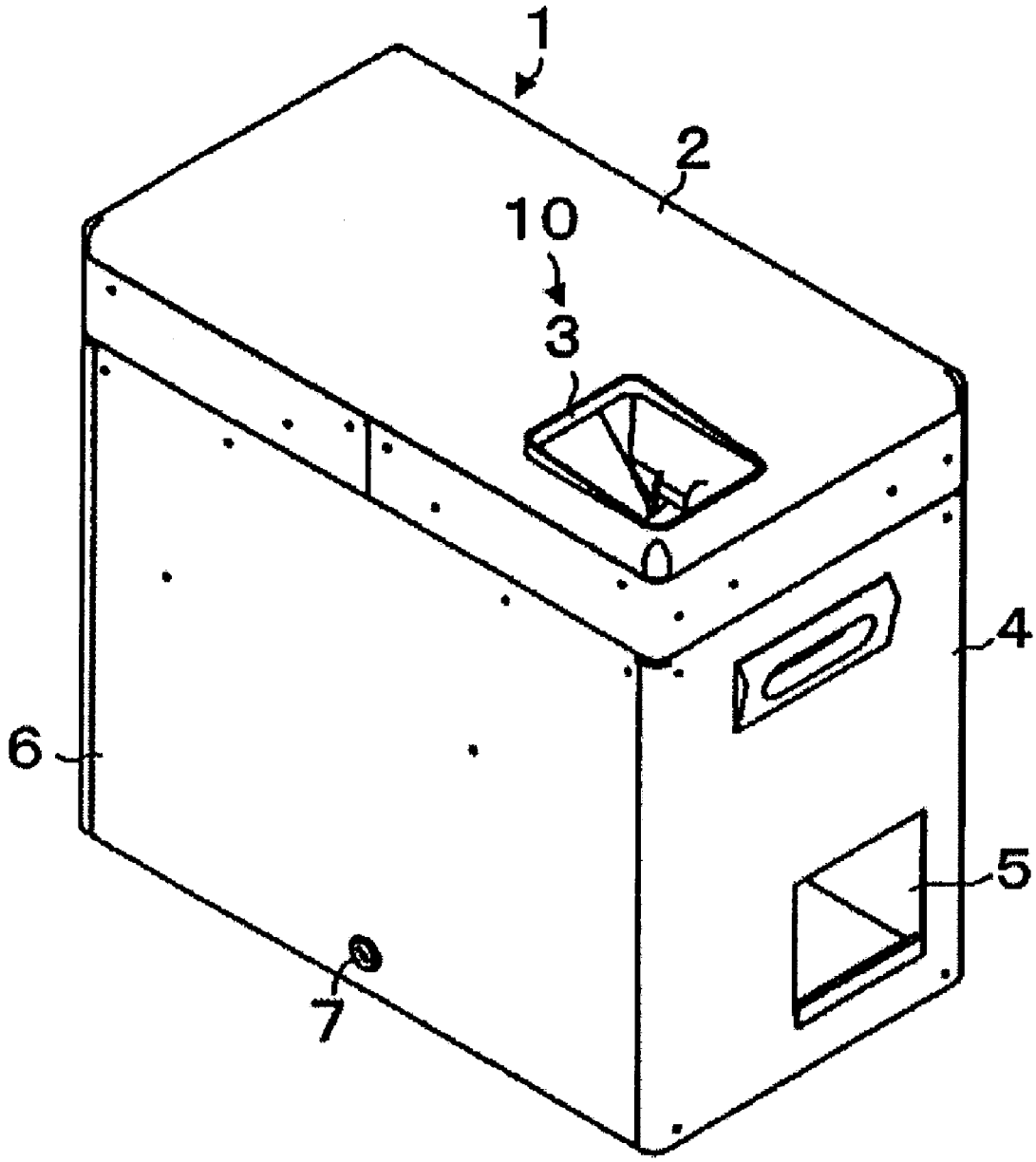
FIG. 9 is a perspective view of a coin receiving and dispensing device of a second embodiment of the present invention which is shown from the front and above.
Figure 17:
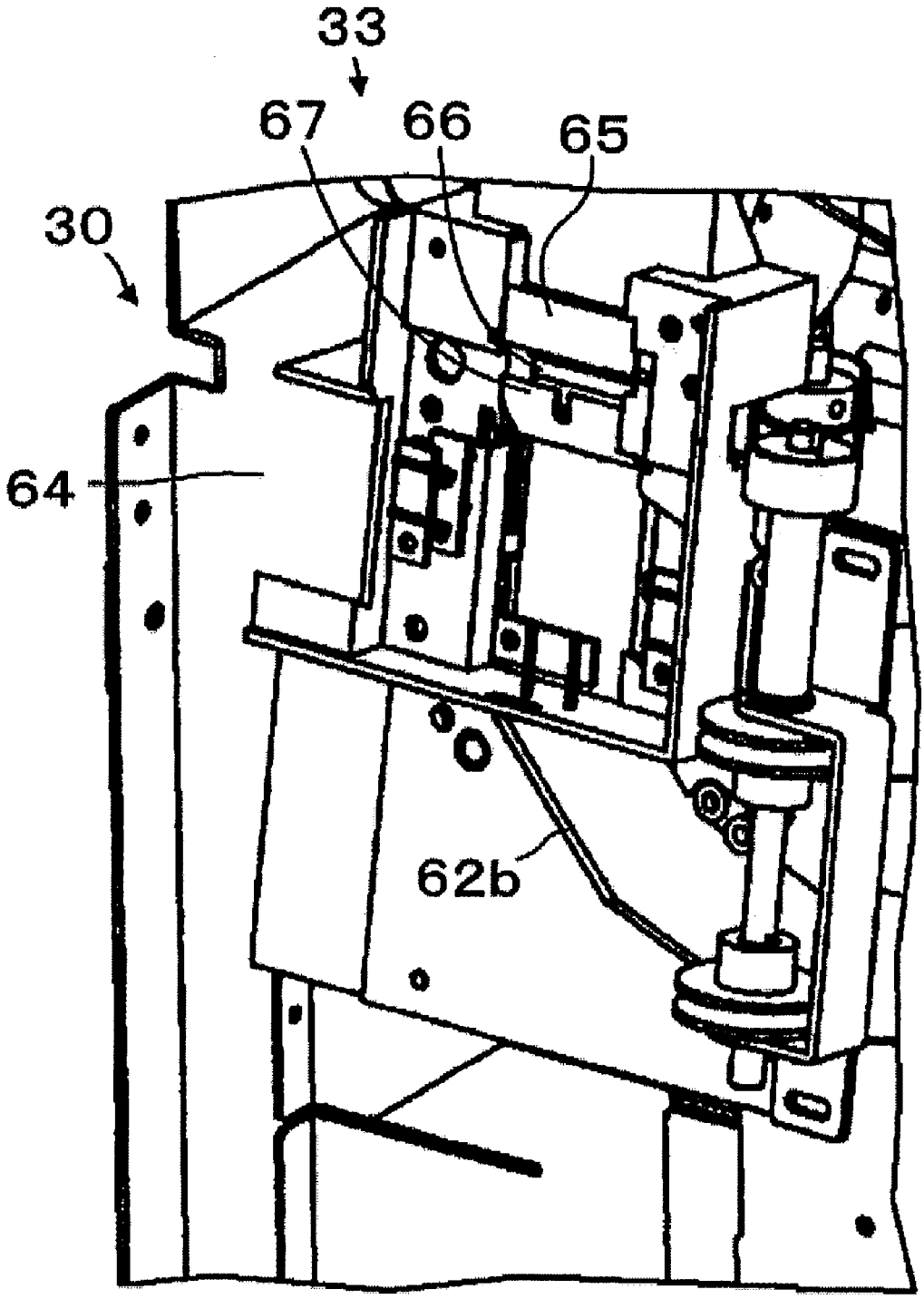
FIG. 17 is a perspective view of the upper and lower diverting device of the second embodiment.

Next, a second embodiment is explained by referring to FIG. 9 through to FIG. 17. Coin receiving and dispensing device 1 has an upper cover 2 with a receiving slot 3 of receiving device 10 and has dispensing slot 5 below front cover 4. Left cover 6 can pivot upwards at a supporting point which is located at the upper end of cover 6. Left cover 6 is locked to the body by locking device 7.

Coin receiving and dispensing device 1 includes a receiving device 10, coin selector 20, diverting device 30, storing section 70, coin dispensing device 85 and dispensing slot 5 which are all aligned. Coin receiving device 10 is shaped like a turned up funnel shape and has a turned up rectangle opening 3. The lower end of receiving device 10 is the circular opening and is located over selector transporting device 21 of coin selector 20.

Coin selecting device 20 includes a selector transporting device 21 and selector 23. Selector transporting device 21 is transporting belt 22. Selector 23 distinguishes between authentic and false dominations of coins which are then lined up on transporting belt 22 and then selector 23 then sends a signal to a main control device [not shown].

Diverting device 30 includes a false diverting device 31 and a genuine diverting device 32. When the coin is false, the false coin which is let off from selector 20 is then guided into dispensing slot 5. When the coin is genuine, the coin is guided into the genuine diverting device 33. Genuine diverting device 33 guides either a first diverting device 33*a* at predetermined dominations or a second diverting device 33*b* also at predetermined dominations.

First diverting device 33*a* includes first genuine transporting device 36*a* and first gauge device 37*a*. First gauge device 37*a* includes first gauge hole line 38*a* and first guiding rail 39*a*. Second diverting device 33*b* includes second genuine transporting device 36*b* and second gauge 37*b*. Second gauge device 37*b* include second gauge hole line 38*b* and second guiding rail 39*b*. First gauge holes line 38*a* and second gauge hole line 38*b* are located along a slanting plane at gauge board 40.

Next, layout of a gauge hole is explained by referring to Euro coins. First gauge hole line 38*a* has four gauge rectangular holes which are located on the upper section as shown in FIG. 6. First gauge hole 45*a* is for a 1 cent coin, second gauge hole 45*b* is for a 10 cent coin, third gauge hole 45*c* is for a 20 cent coin and fourth gauge hole 45*d* is for a 50 cent coin and are located in order from diverting device 30 side.

Figure 15:
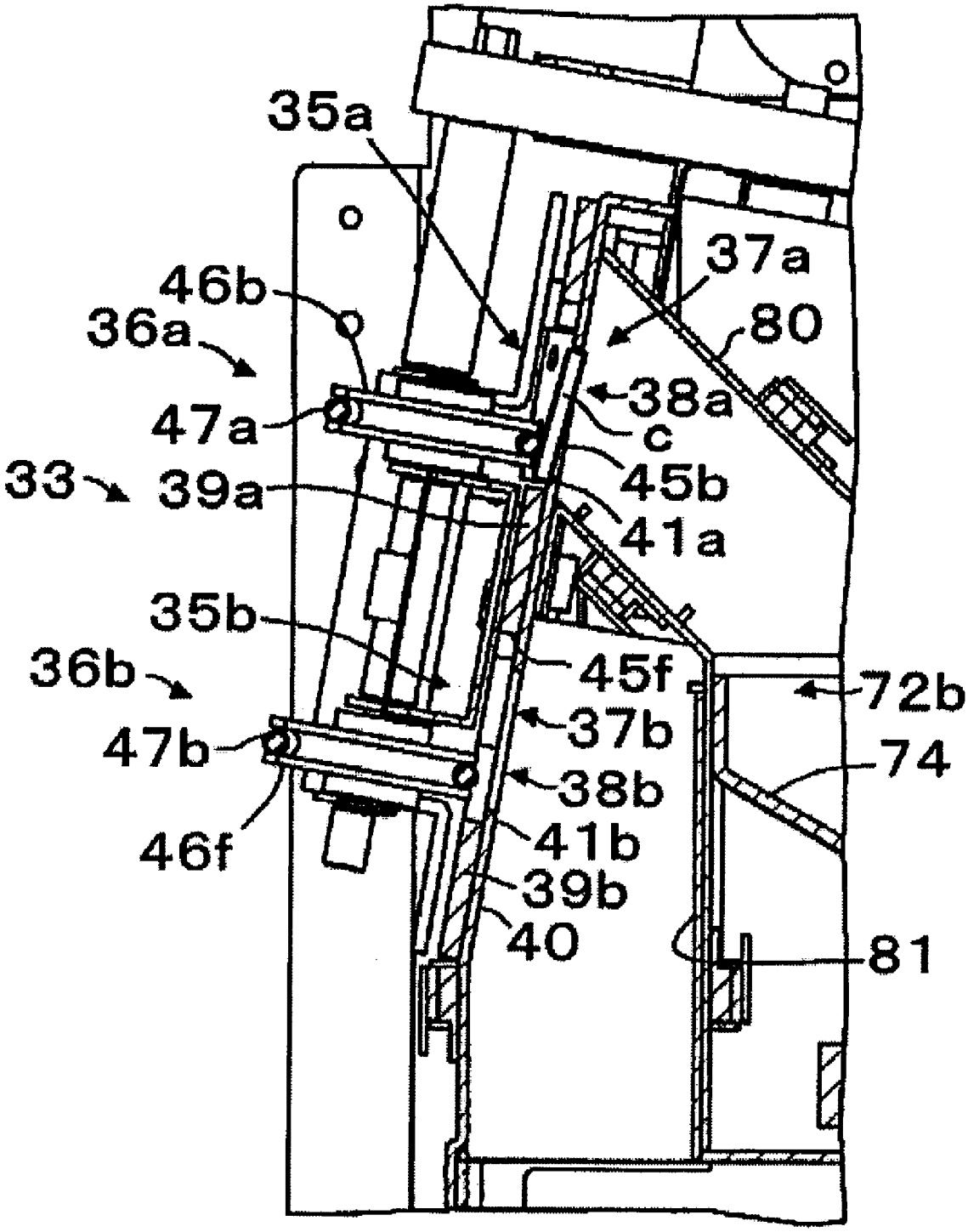
FIG. 15 is a cross sectional view of a gauge section of the second embodiment.

The lower edges of gauge holes 45*a*, 45*b* and 45*c* are located on the same straight line and the lower edge of fourth gauge hole 45*d* is located slightly below this line. The lower edge of fourth gauge hole 45*d* corresponds to the upper surface of first guiding rail 39*a* and is horizontal. In other words, a first falling preventing wall 41*a* is located between the lower edges of gauge holes 45*a*, 45*b*, 45*c* and the upper surface of first guiding rail 39*a* (as shown in FIG. 15). First guiding rail 39*a* and gauge board 40 make up the structure of a first genuine diverting passageway 35*a*.

The upper edges of gauge holes 45*a*, 45*b*, 45*c*, 45*d* are located parallel with the upper surface of first guiding rail 39*a* and are positioned away from the rail 39*a* at a predetermined distance. The upper edges of the coins don't have contact with the edges of the gauge holes. In other words, the heights of gauges 45*a*, 45*b*, 45*c*, 45*d* are in order from smallest to largest along the diverting device 30 side. Second gauge hole line 38*b* has four rectangle gauge holes.

A fifth gauge hole 45*e* is for a 2 cent coin, sixth gauge hole 45*f* is for a 5 cent coin, seventh gauge hole 45*g* is for a 1 Euro and eighth gauge hole 45*h* is for a 2 Euro and are located in order from the diverting device 30 side. The lower edges of gauge holes 45*e*, 45*f* and 45*g* are located on the same straight line and the lower edge of eighth gauge hole 45*h* is located slightly below the line. The lower edge of eighth gauge hole 45*h* corresponds to the upper surface of second guiding rail 39*b* and is horizontal.

A second falling preventing wall 41*b* is located between the lower edges of gauge holes 45*e*, 45*f*, 45*g* and the upper surface of second guiding rail 39*b*. The upper edges of gauge holes 45*e*, 45*f*, 45*g*, 45*h* are located parallel with the upper surface of second guiding rail 39*b* and are located away at a predetermined distance. The upper edges of coins don't have contact. In other words, the heights of gauges 45*e*, 45*f*, 45*g*, 45*h* are in order from smallest to largest from the diverting device 30 side. Second genuine diverting passageway 35*b* is structured by a second guiding rail 39*b* and gauge board 40.

First genuine transporting device 36*a* is located along first gauge holes line 38*a* and includes guiding pulleys 46*a*, 46*b*, 46*c*, 46*d*, first belt 47*a* and first driving pulley 49*a*. Guiding pulleys 46*a*, 46*b*, 46*c*, 46*d* are located opposite gauge holes 46*a*, 45*b*, 45*c*, 45*d*. First belt 47*a* belts first driving pulley 49*a* and guiding pulley 46*d*, and it is guided by guiding pulleys 46*a*, 46*b*, 46*c*. The coins are supported on first guiding rail 39*a* and are transported away from the diverting device 30 by a first belt 47*a*.

The upper edges of fifth gauge hole 45*e*, sixth gauge hole 45*f*, seventh gauge hole 45*g* and eighth gauge hole 45*h* are away from the second guiding rail 39*b* at a predetermined distance because corresponding coins don't have contact with the upper edges. In other words, the heights of gauge holes 45*e*, 45*f*, 45*g*, 45*h* are in order from the smallest to largest from the diverting device 30 side. Second genuine transporting device 36*b* is located along second gauge holes line 38*b*. Second genuine transporting device 36*b* includes guiding rollers 46*e*, 46*f*, 46*g*, 46*h*, second belt 47*b* and second driving pulley 49*b*.

Guiding rollers 46*e*, 46*f*, 46*g*, 46*h* are located opposite gauge holes 45*e*, 45*f*, 45*g*, 45*h*. Second belt 47*b* belts second driving pulley 49*b* and guiding pulley 46*h* and are guided by guiding pulleys 46*e*, 46*f*, 46*g*. The coins are supported on second guiding rail 39*b* and are transported away from diverting device 30 by second belt 47*b*.

First driving pulley 49*a* and second driving pulley 49*b* are fixed at rotating shaft 50. Rotating shaft 50 rotates in conjunction with the selecting transporting device 21. The speed of the first driving pulley 49*a* and the second driving pulley 49*b* is larger than transporting belt 22. First genuine transporting device 36*a* and second genuine transporting device 36*b* can be alternatively changed to other devices which have the same transporting function.

Next diverting device 30 is explained. Diverting device 30 includes receiving passageway 60, canceling passageway 61, first passageway 62*a* and second passageway 62*b*. Receiving passageway 60 extends vertically and receives coins which fall from selector 20. Canceling passageway 61 connects to receiving passageway 60, and it guides the coins into canceling pathway 64.

Canceling pathway 64 connects with dispensing slot 5. First passageway 62*a* guides coins into first genuine diverting passageway 35*a*. Second passageway 62*b* guides coins into second genuine diverting passageway 35*b*. False diverting board 65 is located below receiving passageway 60.

False diverting board 65 pivots at a lower end. When false diverting board 65 is located at the canceling position based on a false determination, it can guide coins into the canceling passageway 61. If the determination of the selector 23 is genuine, false diverting board 65 moves to the receiving position, and the coin is guided into genuine passageway 66.

Figure 16:
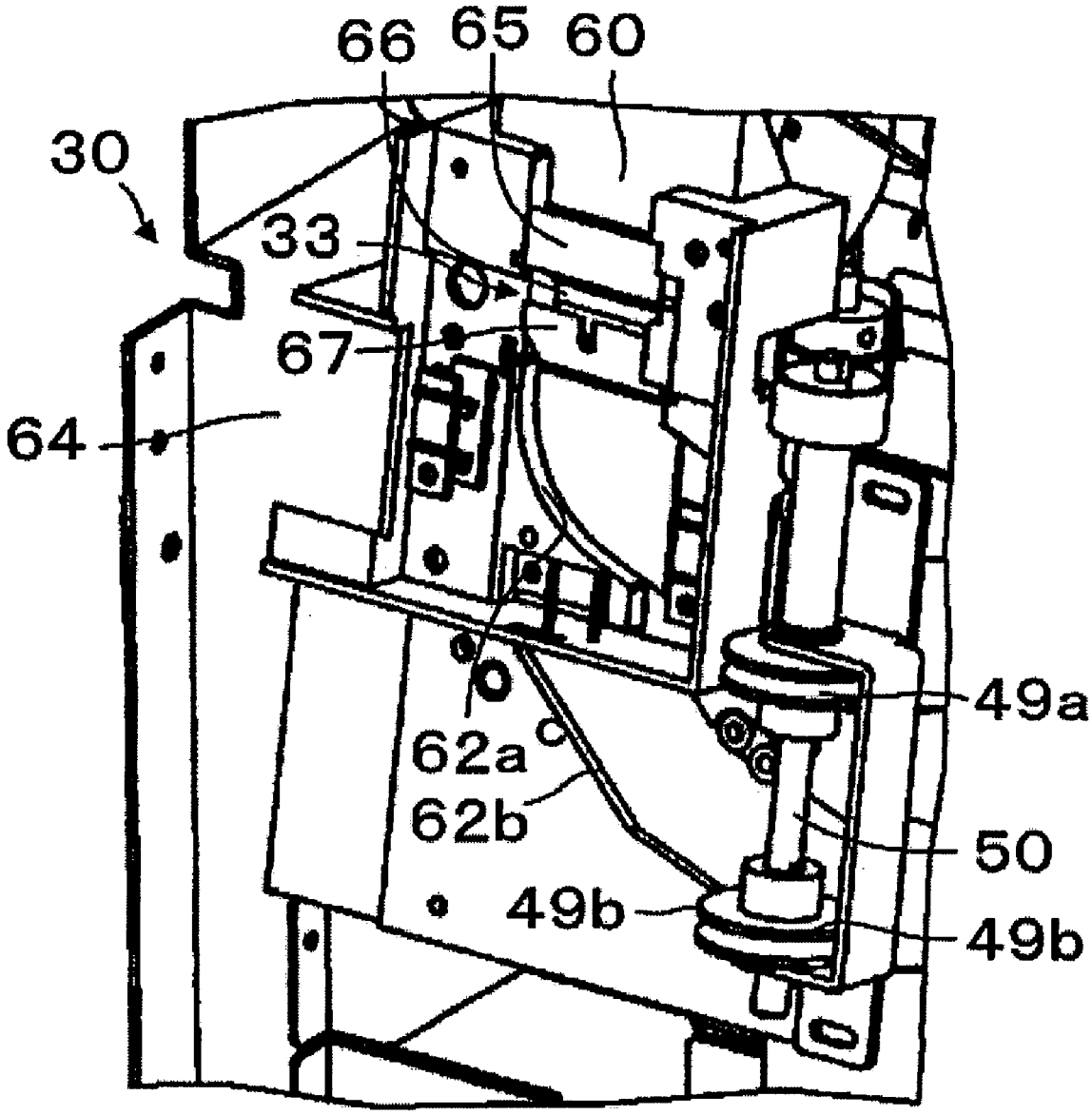
FIG. 16 is a perspective view of the upper and lower diverting device of the second embodiment.

Genuine diverting board 67 is located at genuine passageway 66. When genuine diverting board 67 is located at the position shown in FIG. 16, it guides the coin into a second passageway 62*b*. When the upper section of genuine diverting board 67 moves in a downward direction towards the sheet, it guides the coin into first passageway 62*a*. In other words, canceling passageway 61, first passageway 62*a* and second passageway 62*b* are all lined up in the lateral direction. Genuine diverting device 33 can be changed to other devices which have the same function.

Next, coin storing device 70 is located behind genuine diverting device 33 and is located near coin hoppers which correspond to the gauge holes. First coin hopper 72*a*, second coin hopper 72*b*, third coin hopper 72*c* and fourth coin hopper 72*d* are located on upper base 71 and are arranged parallel to the coin transporting direction of genuine transporting device 34 and are lined up in the lateral direction. Fifth coin hopper 72*e*, sixth coin hopper 72*f*, seventh coin hopper 72*g* and eighth coin hopper 72*h* are located on lower base 73 which is located below upper base 71 and are arranged parallel to the coin transporting direction of genuine transporting device 34 and are lined up in the lateral direction.

Figure 13:
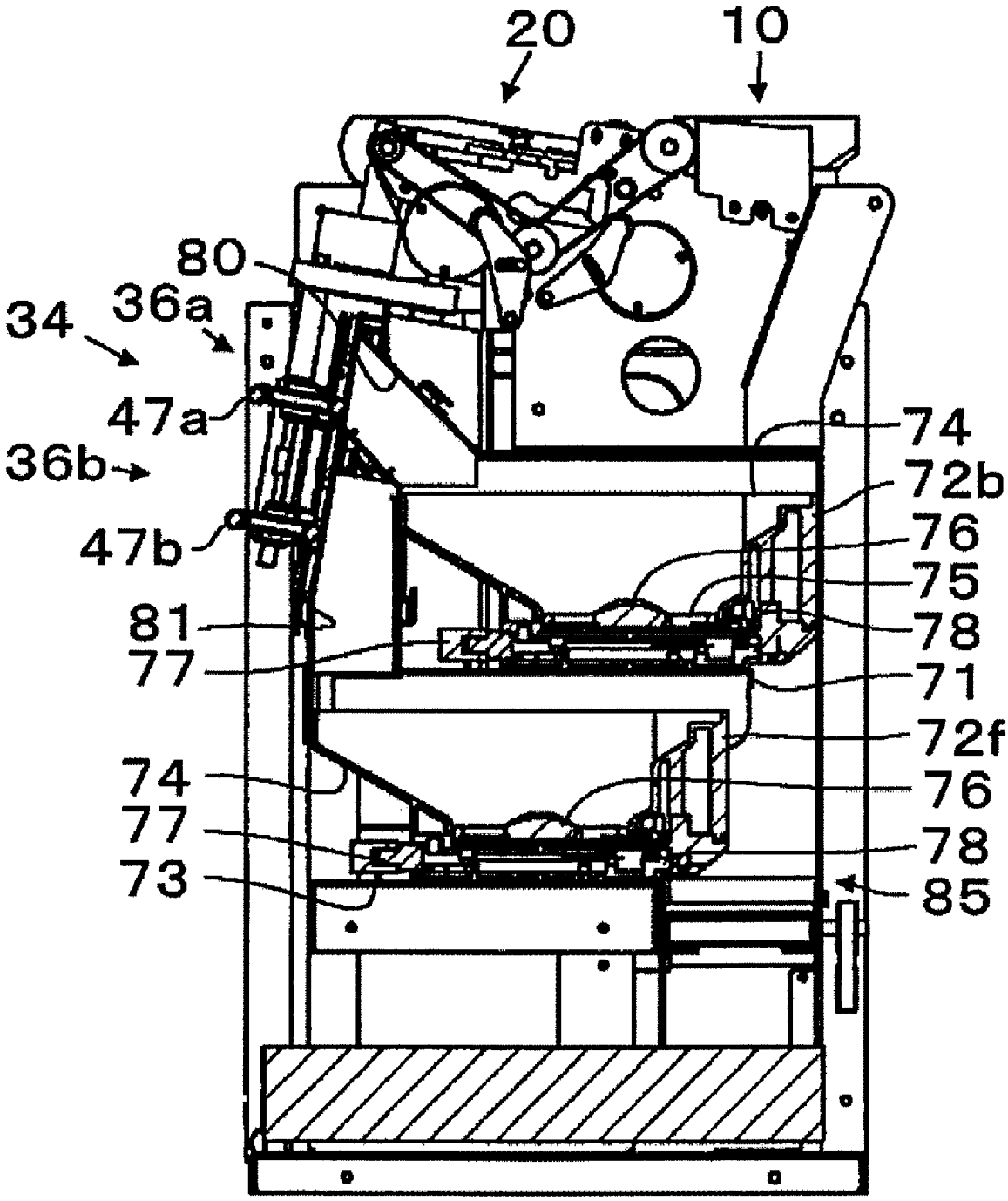
FIG. 13 is a cross section view taken along the X—X line at FIG. 12.
Figure 14:
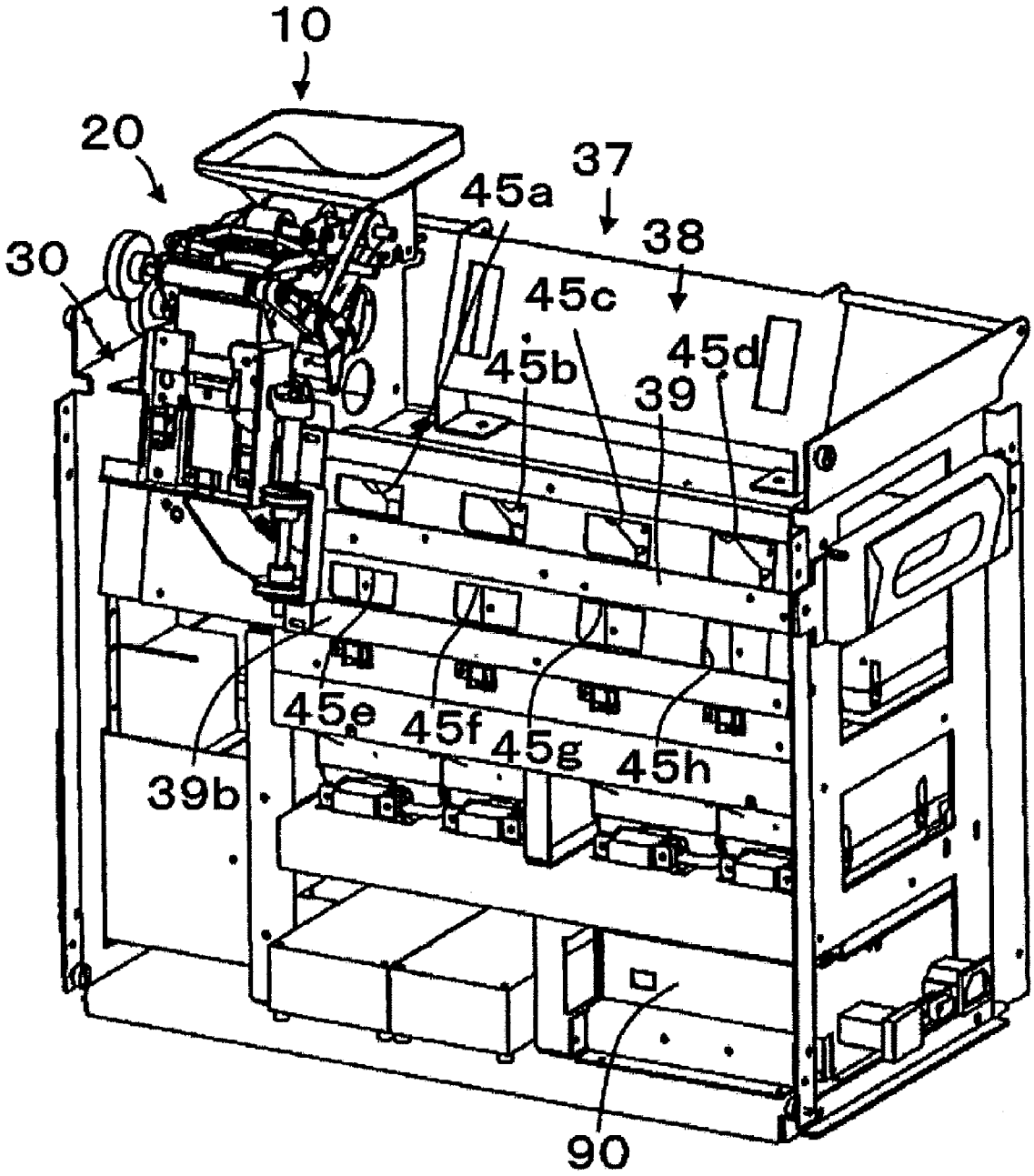
FIG. 14 is a rear perspective view of the second embodiment with the diverting transporting device removed.

Second coin hopper 72*b* is only explained because first coin hopper 72*a* through to eighth coin hopper 72*h* have the same structure. Second coin hopper 72*b* includes a coin bowl 74, a rotating disk 76 with through hole 75, a electrical motor (not shown) and a counter which counts the coins which is let off by rotating disk 76 as shown in FIG. 13. The upper section of coin bowl 74 is rectangular and the lower section is cylindrical. Coin bowl 74 is fixed at hopper base 77.

Figure 10:
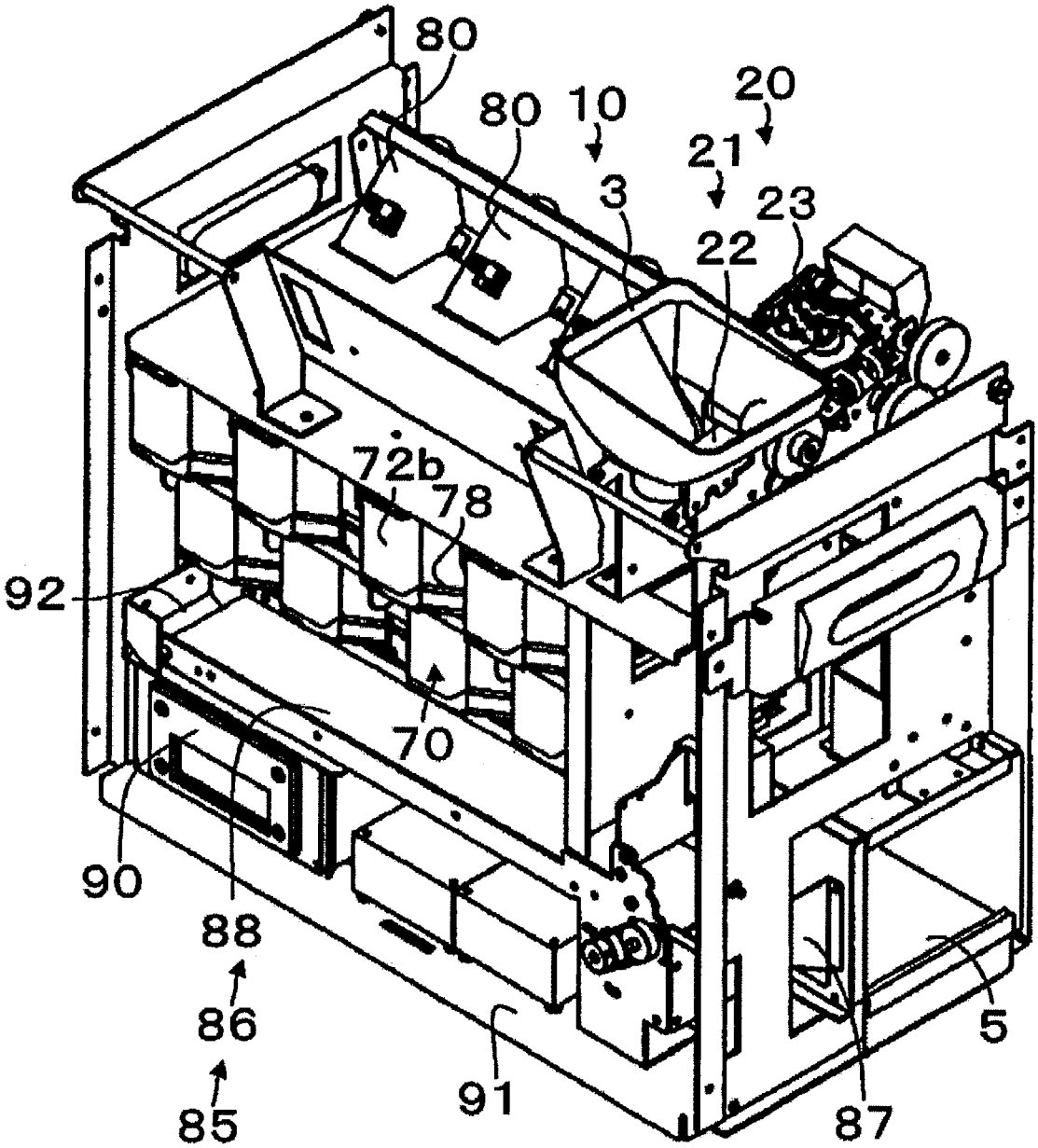
FIG. 10 is a perspective view of a second embodiment with the cover removed.
Figure 11:
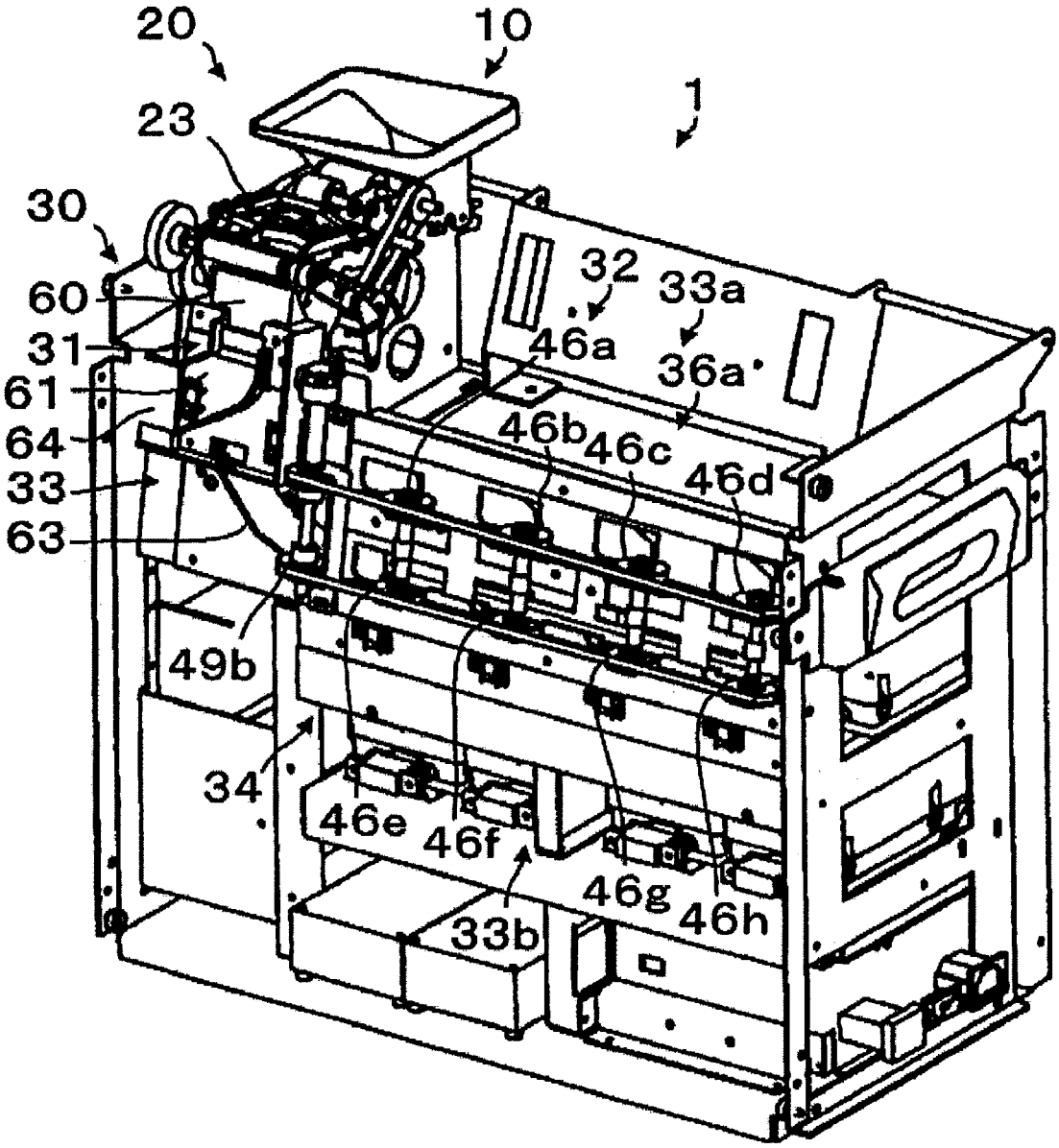
FIG. 11 is a rear perspective view of the second embodiment with the cover removed.

Rotating disk 76 is located in the lower cylindrical section of coin bowl 74. Coin exit slot 78 is located beside rotating disk 76. Coin hopper 72*b* can be moved towards the left cover 6 side along guiding rail (not shown) which is located on upper base 71. In other words, coin hopper 72*b* can be drawn to the left shown in FIG. 10 (the right in FIG. 13). Therefore the replacement of the coins and/or the maintenance of the coin hoppers becomes more convenient.

Figure 12:
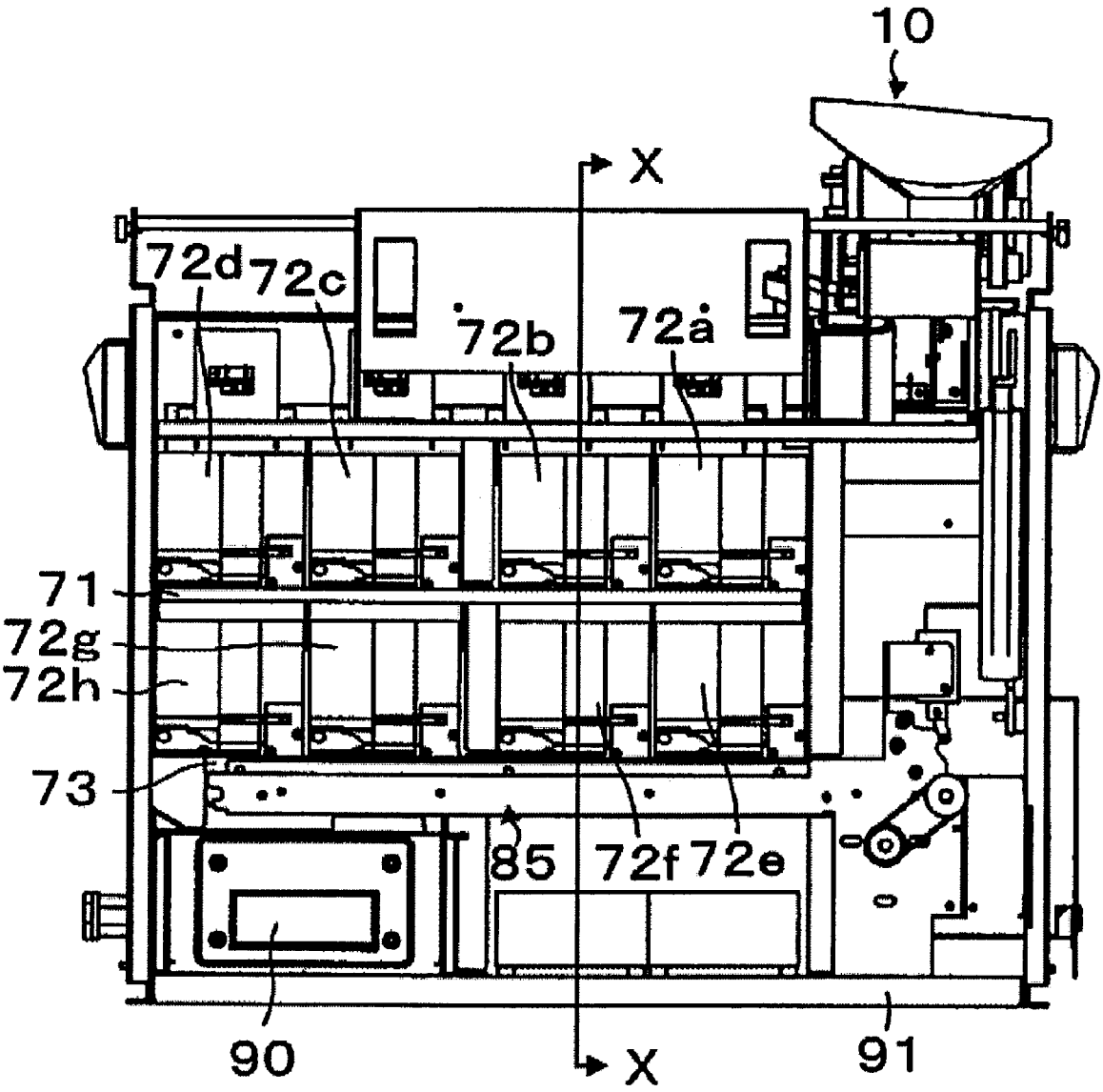
FIG. 12 is a left side elevational view of the second embodiment.

Fifth coin hopper 72*f* is located under second coin hopper 72*b* as shown in FIG. 12. In other words, second coin hopper 72*b* and fifth coin hopper 72*f* are arranged vertically. Second coin hopper 72*b* and sixth coin hopper 72*f* are slightly shifted at a right angle to the coin transporting direction of genuine transporting device 34 as shown FIG. 13.

In other words, second coin hopper 72*b* is located away from genuine transporting device 34 in the lateral direction. Accordingly, the dispensed coins from slot 78 do not enter into coin bowl 74 of coin hopper 72*f* because coin exit slot 78 is over sixth coin hopper 72*e*. The dispensed coins from coin exit slot 78 are guided by each coin hopper and the left cover 6, and they fall down on dispensing device 85. Second coin hopper 72*b* is located below and beside second gauge hole 45*b*.

Fifth coin hopper 72*e* is located under first coin hopper 72*a*, seventh coin hopper 72*g* is located under third coin hopper 72*c*, eighth coin hopper 72*h* is located over fourth coin hopper 72*d*. The coin hopper design can be changed to other coin dispensing devices which have the same function.

First guiding tube 80 guides the coins from second gauge hole 45*b* to coin bowl 74 of second coin hopper 72*b* as shown in FIG. 15, and it slants downwards towards the right. Sixth coin hopper 72*f* is located below and beside sixth gauge hole 48*f*. Sixth gauge hole 45*f* and coin bowl 74 of sixth coin hopper 72*f* are connected by second guiding tube 81 which extends vertically.

Accordingly, first guiding tube 80 and second guiding tube 81 are not arranged at a right angle to the coin transporting direction of genuine transporting device 34. Therefore, the scale of the transporting direction of coin receiving and dispensing device is not large and can be compact. The other coin hoppers and the gauge holes are connected in the same manner as first guiding tube 80 and second guiding tube 81.

The first and second guiding tube can be changed to other devices which have the same function. Next, coin dispensing device 85 is explained. Coin dispensing device 85 includes transporting device 86 and chute 87. Transporting device 86 is located below the exit 78. Transporting device 86 includes belt 88, and it moves toward the normal direction or the opposite direction by a motor (not shown).

Belt 88 is located below lower base 73. When belt 88 moves in the normal direction, the coins are transported towards chute 87 and fall into chute 87. The bottom of chute 87 slants and connects with dispensing slot 5. Safe box 90 is located below belt 82 which is located opposite chute 87.

Transporting device 86 can be changed to other devices which have the same function. Safe box 90 is opened at the upper wall and is located below seventh coin hopper 72*g* and eighth coin hopper 72*h* and can be moved towards the left cover 6 side along the base 91. The coins fall into a falling opening 92 from the end of transporting device 86. Falling opening 92 is connected with the upper opening of safe 90.

Next, the operation of the second embodiment is explained. First, the case where the received coins are stored in corresponding coin hoppers is explained. The coins which are received into receiving slot 3 are transported by belt 22 and are arranged and lined up at a predetermined spaced distance. Afterwards the coins are distinguished by coin selector 23 and when they are genuine, the denomination is distinguished.

When the coins are false, they are guided into the canceling pathway 64 through canceling passageway 61 by the false diverting board 65 and are returned to dispensing slot 5. When the coins are genuine, false diverting board 65 is changed to a genuine position, and receiving passageway 60 and genuine passageway 66 are connected.

When the coins are a 1 cent, a 10 cent, a 20 cent and a 50 cent coin, genuine diverting board 67 connects with genuine passageway 66 and first passageway 62*a*. These denomination coins are guided into first genuine transporting device 36*a* and pass through genuine passageway 66 and first passageway 62*a* from receiving passageway 60. The coins are supported on first guiding rail 39*a* at first genuine transporting device 36*a* and are transported by first belt 47*a*. When the coin is a 1 cent, the upper edge is dislocated from the board at first gauge hole 45*a*, and the coin slants into first gauge hole 45*a* and falls down into first guiding tube 80, and it is guided to coin bowl 74 of first coin hopper 72*a*.

When the coin is a 10 cent coin, it is supported at first gauge hole 45*a* and passes through, as a result, it falls down into first guiding tube 80 at second gauge hole 45*b* and is stored in coin bowl 74 of coin hopper 72*b*. When the coin is a 20 cent coin, it is supported at first gauge hole 45*a* and second gauge hole 45*b* and passes through, as a result, it falls down into first guiding tube 80 at third gauge hole 45*c* and is stored in coin bowl 74 of coin hopper 72*c*.

When the coin is a 50 cent coin, it is supported at first gauge hole 45*a*, second gauge hole 45*b* and third gauge hole 45*c* and passes through, as a result, it falls down into first guiding tube 80 at fourth gauge hole 45*d* and is stored in coin bowl 74 of coin hopper 72*d*. When the coin is a 2 cent, a 5 cent, a 1 Euro and a 2 Euro, genuine diverting board 67 changes position, and genuine passageway 66 and second passageway 62*b* are connected. Accordingly, the coins reach second genuine transporting device 36*b*, afterwards they are supported by second guiding rail 39*b* and are transported by second belt 47*b*. Therefore the coins are transported by second belt 47*b* in the same manner as first genuine transporting device 36*a*.

When the coin is a 2 cent coin, it is not supported at fifth gauge hole 45*e* and, as a result, it falls down into second guiding tube 81 at fifth gauge hole 45*e* and is stored in coin hopper 72*e*. When the coin is a 5 cent coin, it is supported at fifth gauge hole 45*e* and passes through, as a result, it falls down into second guiding tube 81 at sixth gauge hole 45*e* and is stored in sixth coin hopper 72*e*. When the coin is a 1 Euro coin, it is supported at fifth gauge hole 45*e* and sixth gauge hole 45*f* and passes through, as a result, it falls down into second guiding tube 81 at seventh gauge hole 45*g* and is stored in seventh coin hopper 72*g*.

When the coin is a 2 Euro coin, it is supported at fifth gauge hole 45*e*, sixth gauge hole 45*f* and seventh gauge hole 45*g* and passes through, as a result, it falls down into second guiding tube 81 at eighth gauge hole 45*h* and is stored in eighth coin hopper 72*h*. Next, the case where the denomination coins are dispensed one by one is explained.

Fourth coin hopper 72*d*, eighth coin hopper 72*h*, third coin hopper 72*c*, seventh coin hopper 72*g*, second coin hopper 72*b*, sixth coin hopper 72*f*, first coin hopper 72*a* and fifth coin hopper 75*e* do not start at the same time as explained in the first embodiment. Rotating discs 76 rotate at each coin hopper, and one coin is dispensed from exit slot 78.

The dispensed coins are guided by each coin hopper and left cover 6, and they fall down on belt 88. Belt 88 moves towards chute 87 side based on the dispensing signal. Accordingly, the dispensed coins fall down onto belt 88 and fall down into chute 87, and they slide down on chute 87 into dispensing slot 5.

All coins fall down to chute 87, finally belt 88 stops. When the coins in each coin hoppers are recycled, belt 88 is moved in the reverse direction, and the coins are transported to the falling opening 92 and are stored in safe 90.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A receiving and dispensing device for coins comprising:

a receiving device for the entry of coins;

a selecting transporting device which can separate the received coins from the receiving device and transport the separated coins along a selecting section, the selecting section includes a transporting passageway including an endless member for transporting coins of various widths to be released from the transporting passageway;

a plurality of coin hoppers operatively positioned, each to receive a coin of a different denomination from the transporting passageway and capable of dispensing the received coins;

the plurality of coin hoppers are positioned to extend in a horizontal direction with the plurality of coin hoppers divided vertically into a plurality of upper coin hoppers and a plurality of lower coin hoppers that are aligned into a compact configuration to provide coin storage at two levels; and guiding passageways guide to coins from the selecting section to the respective coin hoppers, the selecting section includes an upper selecting section and a lower selecting section, the upper selecting section is connected with coin hoppers vertically positioned in a first row and the lower selecting section is connected with lower coin hoppers positioned vertically below the upper coin hoppers, wherein the endless member translates coins horizontally in a first direction and elevates the coins to translate the coins in a second direction that is in a reverse direction to the first direction.

2. The receiving and dispensing device for coins as claimed in claim 1 wherein the selecting transporting device further includes guiding rails positioned above the respective upper and lower plurality of coin hoppers and the endless member transports the coins along the guiding rails.

3. The receiving and dispensing device for coins as claimed in claim 2 wherein the selecting section includes gauge rails which are located parallel to and at a predetermined distance from the guiding rails to assist in releasing coins to the guiding passageway.

4. The receiving and dispensing device for coins as claimed in claim 1 wherein the transporting passageway of the selecting transporting device arrange the coins to be slanted relative to a vertical plane and the upper and lower selecting sections are positioned adjacent the endless member as it travels in a first direction and returns in a second direction.

5. The receiving and dispensing device for coins as claimed in claim 1 further including a coin authenticating unit to authenticate the coins before the selecting transporting device.

6. A compact coin receiving and dispensing apparatus comprising:

a receiving device for the introduction of coins of different denominations;

an authenticating unit for verifying the authenticity of the coins;

a selecting transportation device including an endless member for separating authenticated coins tat are translated to segregate the authenticated coins in accordance with each coin's denomination at a first series of spaced position and at a second series of spaced positions below the first series of spaced positions, wherein the endless member translates coins horizontally in a first direction and elevates the coins to translate the coins in a second direction that is in a reverse direction to the first direction;

a first set of coin hoppers; and a second set of coin hoppers positioned below the first set of coin hoppers, the first set of coin hoppers is operatively positioned to receive the segregated authenticated coins from the first series of spaced positions and the second set of coin hoppers is operatively positioned to receive the segregated authenticated coins from the second series of spaced positions wherein a vertically stacked arrangement of the first set of coin hoppers and the second set of coin hoppers enable a compact configuration, wherein the endless member translates authenticated coins past the first series of spaced positions at a first vertical level and past the second series of spaced positions at a second vertical level, the first vertical level and second vertical level are above the stacked arrangement of coin hoppers.

7. In a coin receiving and dispensing apparatus for receiving and storing a plurality of different denominations of moving coins, the improvement comprising:

a coin selecting unit for segregating the plurality of coins into respective denominations including an endless member that translates coins horizontally in a first direction and elevates the coins to translate the coins in a second direction that is in a reverse direction to the first direction; and a plurality of coin hoppers positioned below the coin selecting unit, the plurality of coin hoppers including a first set of coin hoppers and a second set of coin hoppers positioned below the first set of coin hoppers, the coin selecting unit includes a first selecting section operatively connected to the first set of coin hoppers and a second selecting section located below the first selecting section and operatively connected to the second set of coin hoppers.

8. The coin receiving and dispensing apparatus as claimed in claim 7 wherein the coin selecting unit further includes guide rails positioned above the plurality of coin hopper end an endless belt for transporting the coins along the guiding rails.

9. The coin receiving and dispensing apparatus as claimed in claim 8 wherein the coin selecting unit includes gauge rails which are located parallel to and at a predetermined distance from the guiding rails to assist in releasing coins.

10. The coin receiving and dispensing apparatus as claimed in claim 8 wherein to coin selecting unit arranges the coins to be slanted relative to a vertical plane and the upper and lower selecting sections are positioned adjacent the endless belt as it travels in a first direction and returns in a second direction.

11. The coin receiving and dispensing apparatus as claimed in claim 8 further including a coin authenticating unit to authenticate the coins before the coin selecting unit device.

12. A receiving and dispensing device for coins comprising:

a receiving device for the entry of coins;

a selecting transporting device which can separate the received coins from the receiving device and transport the separated coins along a selecting section, the selecting section includes a transporting passageway which permits coins of various widths to be released from the transporting passageway;

an endless member for translating the coins along the transporting passageway;

a plurality of coin hoppers operatively positioned, each to receive a coin of a different denomination from the passageway and capable of dispensing the received coins, a lower coin hopper line where a plurality of coin hoppers are located on a base and are arranged in a row, a upper coin hopper line where a plurality of coin hoppers are located on a base and are arranged in a row which are located adjacent and above the lower coin hopper line in parallel, wherein the selecting transporting device includes an upper selecting section and a lower selecting section, the upper selecting section is connected with coin hoppers vertically positioned in a first row and the lower selecting section is connected with lower coin hoppers positioned vertically below the upper coin hoppers, wherein the endless member translates coins horizontally in a first direction and elevates the coins to translate the coins in a second direction that is in a reverse direction to the first direction; and guiding passageways guide the coins from the respective selecting sections to the respective coin hoppers.

* * * * *